US010694272B2

(12) United States Patent
Hong

(10) Patent No.: US 10,694,272 B2
(45) Date of Patent: Jun. 23, 2020

(54) SOUND BAR APPARATUS HAVING DETACHABLE SOUND TRANSDUCER

(71) Applicant: SAMSUNG ELECTRONICS CO., LTD., Suwon-si, Gyeonggi-do (KR)

(72) Inventor: Seung-se Hong, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/850,669

(22) Filed: Dec. 21, 2017

(65) Prior Publication Data

US 2018/0184182 A1 Jun. 28, 2018

(30) Foreign Application Priority Data

Dec. 23, 2016 (KR) ..... 10-2016-0177461

(51) Int. Cl.

| | |
|---|---|
| ***H04R 3/00*** | (2006.01) |
| ***H04R 1/02*** | (2006.01) |
| ***H04R 1/28*** | (2006.01) |
| ***H04R 3/12*** | (2006.01) |
| ***H04R 3/14*** | (2006.01) |
| ***H04R 5/02*** | (2006.01) |
| *H04R 1/26* | (2006.01) |
| *H04R 5/04* | (2006.01) |

(52) U.S. Cl.

CPC ..... *H04R 1/02* (2013.01); *H04R 1/2803* (2013.01); *H04R 3/12* (2013.01); *H04R 3/14* (2013.01); *H04R 5/02* (2013.01); *H04R 1/26* (2013.01); *H04R 5/04* (2013.01); *H04R 2420/07* (2013.01); *H04R 2499/15* (2013.01)

(58) Field of Classification Search

CPC ... H04R 5/04; H04R 2420/05; H04R 2420/07
See application file for complete search history.

(56) References Cited

U.S. PATENT DOCUMENTS

| | | | |
|---|---|---|---|
| 8,272,804 | B2 | 9/2012 | Hsu et al. |
| 8,693,722 | B2 | 4/2014 | Liu |
| 8,761,432 | B1 | 6/2014 | Cheng |

(Continued)

FOREIGN PATENT DOCUMENTS

| | | |
|---|---|---|
| CN | 201403179 | 2/2010 |
| JP | 3166087 | 2/2011 |

(Continued)

OTHER PUBLICATIONS

Search Report and Written Opinion dated Apr. 17, 2018 in counterpart International Patent Application No. PCT/KR2017/015299.

(Continued)

*Primary Examiner* — Amir H Etesam
(74) *Attorney, Agent, or Firm* — Nixon & Vanderhye P.C.

(57) ABSTRACT

A sound bar apparatus having a detachable sound transducer includes a sound bar body comprising an audio signal processor and a plurality of terminals; and a sound transducer housing comprising a connection terminal connected to one of the plurality of terminals of the sound bar body, wherein the plurality of terminals are connected in parallel in a longitudinal direction of the sound bar body, and the sound transducer housing is configured to be detachably connected to the sound bar body.

20 Claims, 31 Drawing Sheets

(56) References Cited

U.S. PATENT DOCUMENTS

| | | | | |
|---|---|---|---|---|
| 2005/0207603 | A1* | 9/2005 | Tse | H04R 5/02 381/351 |
| 2009/0246979 | A1* | 10/2009 | Rodrigues | H01R 13/6205 439/39 |
| 2010/0008522 | A1* | 1/2010 | Sumitani | H04R 1/026 381/182 |
| 2012/0042484 | A1 | 2/2012 | Hsu et al. | |
| 2012/0308065 | A1 | 12/2012 | Padalino et al. | |
| 2013/0301861 | A1* | 11/2013 | Ho | H04R 1/023 381/332 |
| 2015/0104037 | A1* | 4/2015 | Lee | H04R 27/00 381/80 |

FOREIGN PATENT DOCUMENTS

| | | |
|---|---|---|
| KR | 10-2009-0099669 | 9/2009 |
| KR | 10-0962595 | 6/2010 |

OTHER PUBLICATIONS

Extended EP Search Report dated Nov. 18, 2019 for EP Application No. 17883364.6.

* cited by examiner

SOUND BAR APPARATUS HAVING DETACHABLE SOUND TRANSDUCER

CROSS-REFERENCE TO RELATED APPLICATIONS

This application is based on and claims priority under 35 U.S.C. § 119 to Korean Patent Application No. 10-2016-0177461 filed Dec. 23, 2016 in the Korean Intellectual Property Office, the disclosure of which is incorporated by reference herein in its entirety.

BACKGROUND

1. Field

The present disclosure relates generally to a sound bar apparatus used in flat panel display apparatuses. For example, the present disclosure relates to a sound bar apparatus having a detachable sound transducer that can be used in flat panel display apparatuses of various sizes.

2. Description of Related Art

As the thickness of flat panel display apparatus such as a liquid crystal display (LCD) televisions, a light emitting diode (LED) television, or the like becomes thinner, there is a problem that the performance of a built-in speaker provided in the flat panel display apparatus is limited.

In recent years, a sound bar is widely used together with a thin flat panel display apparatus to solve the performance limitation of such a built-in speaker. Referring to FIG. 1, a conventional sound bar 5 is formed to have a length similar to the width of the flat panel display apparatus 1 and is provided in front of the flat panel display apparatus 1 for the stereo effect and matching with the flat panel display apparatus 1.

However, the thin flat panel display apparatus 1 is commercially available in various screen sizes according to the demand of users. For example, the flat panel display apparatus 1 is available in various screen sizes such as 32 inches, 42 inches, 55 inches and 65 inches.

Accordingly, various models of the sound bar 5 having different lengths corresponding to the flat panel display apparatuses 1 of various sizes are developed and put on the market. For example, a 42-inch sound bar is used for a 42-inch flat panel display apparatus, and a 65-inch sound bar is used for a 65-inch flat panel display apparatus.

However, the provision of a dedicated sound bar for each of flat panel display apparatuses of various sizes has a problem in that the manufacturing cost is high and management is difficult.

Accordingly, a sound bar structure that can be applied to flat panel display apparatuses of various sizes is required.

SUMMARY

The present disclosure has been developed to address the above drawbacks and other problems associated with the conventional arrangement. An example aspect of the present disclosure relates to a sound bar apparatus having a detachable sound transducer that can be used with flat panel display apparatuses of various sizes.

According to an example aspect of the present disclosure, a sound bar apparatus having a detachable sound transducer may include a sound bar body comprising an audio signal processor and a plurality of terminals; and a sound transducer housing comprising a connection terminal connected to one of the plurality of terminals of the sound bar body, wherein the plurality of terminals are connected in parallel in a longitudinal direction of the sound bar body, and wherein the sound transducer housing is detachably disposed in the sound bar body.

The plurality of terminals may comprise a plurality of left terminals provided near a left end of the sound bar body and a plurality of right terminals provided near a right end of the sound bar body.

The sound transducer housing may include a sound transducer for a mid-frequency range; a sound transducer for a high-frequency range; a crossover network for a mid-frequency range provided between the connection terminal and the sound transducer for the mid-frequency range; and a crossover network for a high-frequency range provided between the connection terminal and the sound transducer for the high-frequency range.

An amplifier may include a mid-range amplifier and a tweeter amplifier. The plurality of terminals may include a plurality of mid-range terminals connected in parallel to the mid-range amplifier and a plurality of tweeter terminals connected in parallel to the tweeter amplifier.

The sound transducer housing may include a sound transducer for a mid-frequency range and a sound transducer for a high-frequency range. The connection terminal may include a mid-range connection terminal connected to the sound transducer for the mid-frequency range and a tweeter connection terminal connected to the sound transducer for the high-frequency range.

One of the plurality of terminals of the sound bar body and the connection terminal of the sound transducer housing may comprise a conductive magnet and a other one of the terminals and the connection terminal may comprise a conductive metal material.

The connection terminal of the sound transducer part may be provided on a bottom surface of an enclosure.

The sound bar body may be configured to extend and retract in a telescopic manner.

The sound bar body may include a center block in which the audio signal processor is provided; a pair of terminal blocks detachably disposed at both ends of the center block, each of the pair of terminals including one terminal, and an extension block detachably disposed between the center block and the pair of terminal blocks.

According to another example aspect of the present disclosure, a sound bar apparatus having a detachable sound transducer may include a sound bar body comprising an audio signal processor and a plurality of fixing portions (couplers); and a sound transducer housing comprising a coupling portion (coupler) connected to one of the plurality of fixing portions of the sound bar body, wherein the plurality of fixing portions are provided in a longitudinal direction of the sound bar body, and wherein the sound transducer is detachably disposed in the sound bar body.

The plurality of fixing portions provided on the sound bar body and the coupling portion provided on the sound transducer part may be formed in a terminal for transmitting audio signals.

The sound bar body and the sound transducer part may transmit and receive power and audio signals wirelessly.

Other objects, advantages and salient features of the present disclosure will become apparent from the following detailed description, which, taken in conjunction with the annexed drawings, discloses various example embodiments.

BRIEF DESCRIPTION OF THE DRAWINGS

These and/or other aspects, features and attendant advantages of the present disclosure will become apparent and more readily appreciated from the following detailed description, taken in conjunction with the accompanying drawings, in which like reference numerals refer to like elements, and wherein.

Throughout the drawings, like reference numerals will be understood to refer to like parts, components and structures.

DETAILED DESCRIPTION

Hereinafter, various example embodiments of the present disclosure will be described in greater detail with reference to the accompanying drawings.

The matters defined herein, such as a detailed construction and elements thereof, are provided to assist in a comprehensive understanding of this description. Thus, it is apparent that various example embodiments may be carried out without those defined matters. Also, well-known functions or constructions may be omitted to provide a clear and concise description of example embodiments. Further, dimensions of various elements in the accompanying drawings may be arbitrarily increased or decreased to aid in a comprehensive understanding.

Figure 2:
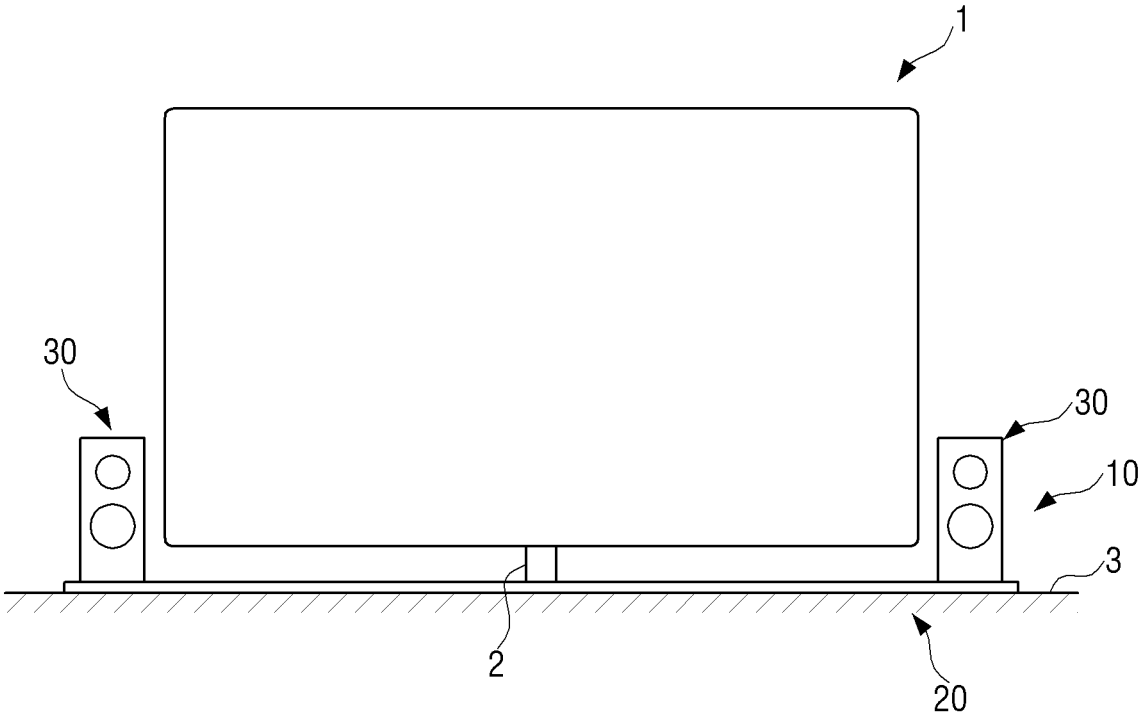
FIG. 2 is a diagram illustrating an example sound bar apparatus having a detachable sound transducer provided in a flat panel display apparatus according to an example embodiment of the present disclosure.
Figure 3:
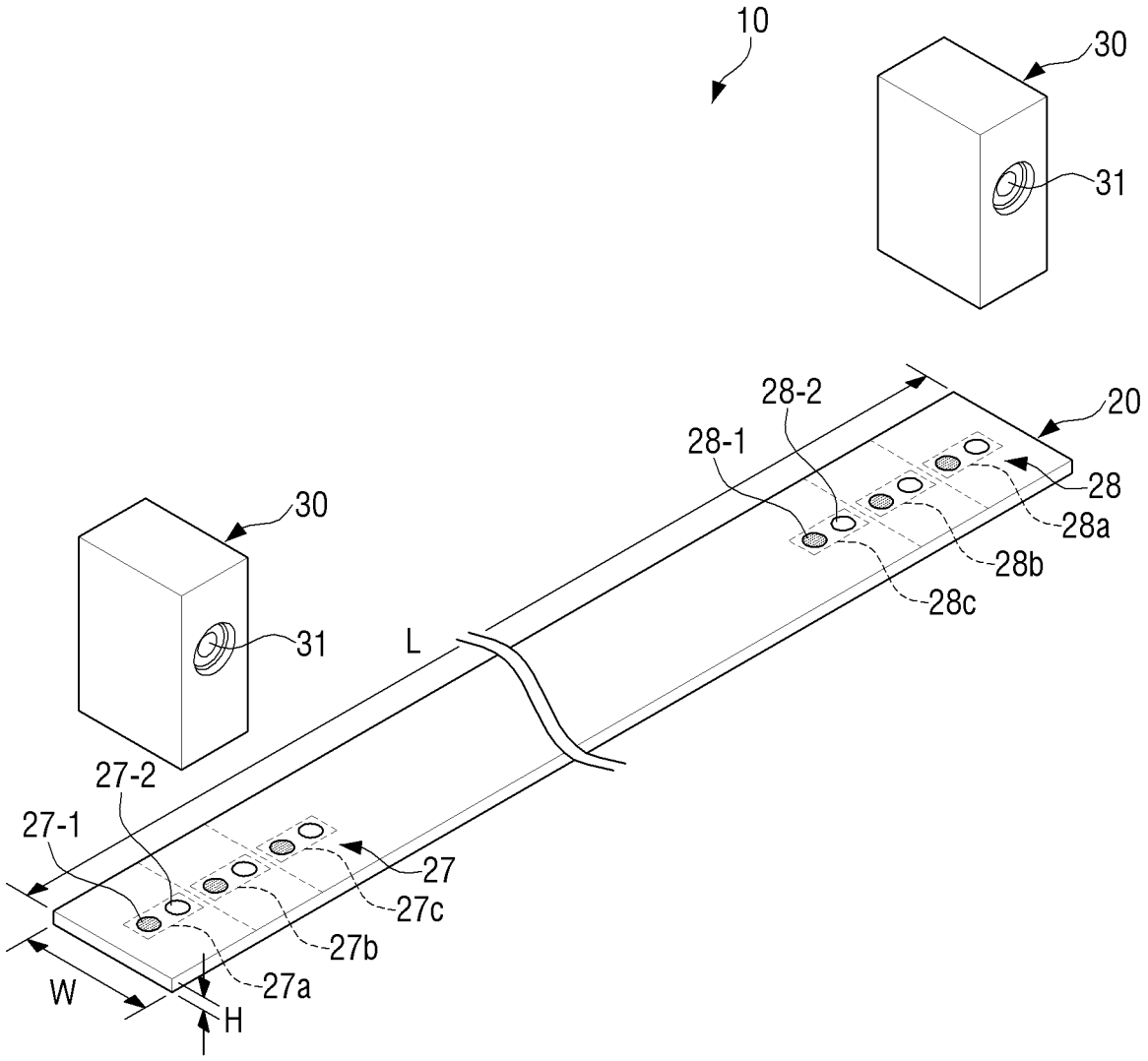
FIG. 3 is an exploded perspective view illustrating an example sound bar apparatus having a detachable sound transducer according to an example embodiment of the present disclosure.
Figure 4:
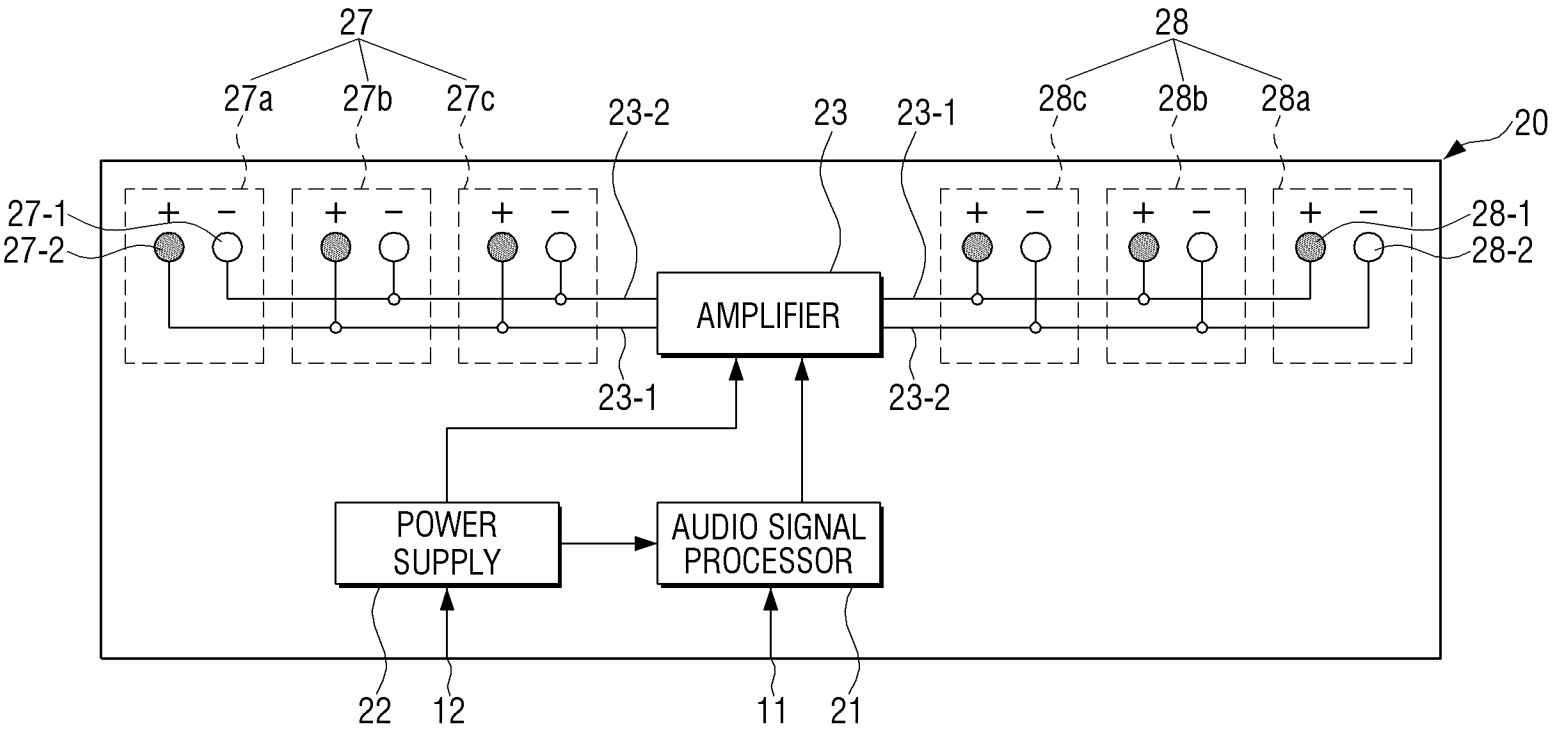
FIG. 4 is a block diagram illustrating an example sound bar body of a sound bar apparatus having a detachable sound transducer according to an example embodiment of the present disclosure.
Figure 5:
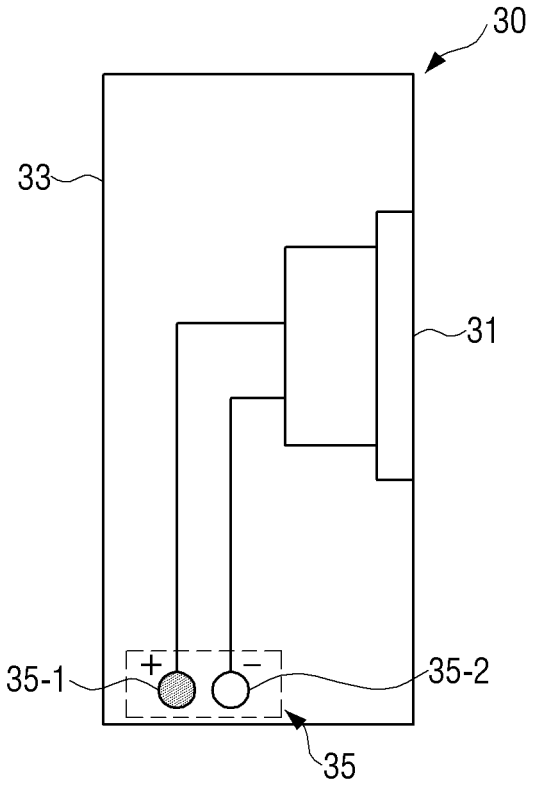
FIG. 5 is a cross-sectional view illustrating an example sound transducer part of a sound bar apparatus having a detachable sound transducer according to an example embodiment of the present disclosure.
Figure 6:
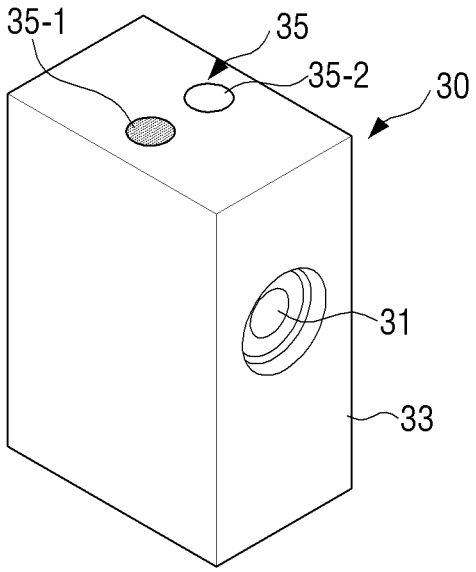
FIG. 6 is a rear perspective view illustrating an example sound transducer part of a sound bar apparatus having a detachable sound transducer according to an example embodiment of the present disclosure.

FIG. 2 is a diagram illustrating an example sound bar apparatus having a detachable sound transducer according to an example embodiment of the present disclosure disposed in a flat panel display apparatus. FIG. 3 is an exploded perspective view illustrating an example sound bar apparatus having a detachable sound transducer according to an example embodiment of the present disclosure. FIG. 4 is a block diagram illustrating an example sound bar body of a sound bar apparatus having a detachable sound transducer according to an example embodiment of the present disclosure. FIG. 5 is a cross-sectional view illustrating an example sound transducer part (it is noted that the sound transducer part may be referred to herein as the sound transducer housing) of a sound bar apparatus having a detachable sound transducer according to an example embodiment of the present disclosure. FIG. 6 is a rear perspective view illustrating an example sound transducer part of a sound bar apparatus having a detachable sound transducer according to an example embodiment of the present disclosure.

Referring to FIGS. 2 and 3, a sound bar apparatus 10 having a detachable sound transducer according to an example embodiment of the present disclosure may include a sound bar body 20 and a sound transducer part 30.

Figure 1:
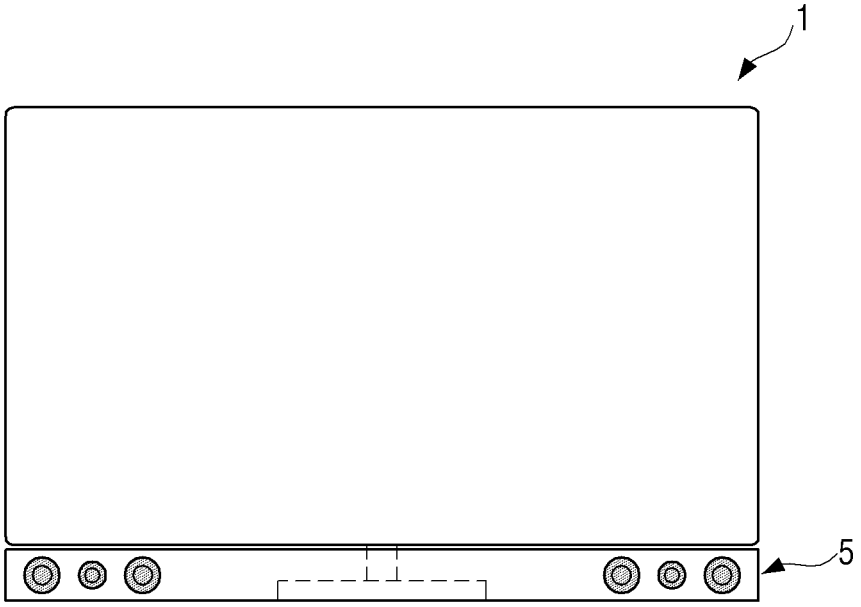
FIG. 1 (CONVENTIONAL ART)
FIG. 1 is a diagram illustrating a conventional sound bar applied to a flat panel display apparatus.

The sound bar body 20 may be disposed in front of a flat panel display apparatus 1 and may be formed in a long rod shape. For example, the sound bar body 20 may be formed in a substantially rectangular parallelepiped shape having a low height H, a narrow width W, and a long length L, as illustrated in FIG. 3. The length L of the sound bar body 20 may be determined to correspond to the width of the largest flat panel display apparatus 1 among flat panel display apparatuses of various sizes to which the sound bar apparatus 10 of the present disclosure is applied. In addition, since the sound bar body 20 according to the present disclosure does not include a sound transducer, a space in which the sound transducer is disposed may be reduced. Therefore, the height or thickness of the sound bar body 20 may be made much lower or thinner than that of the conventional sound bar 5 (see FIG. 1) including the sound transducer.

For example, in the case where the sound bar apparatus 10 of the present disclosure is formed to be applicable to the flat panel display apparatuses 1 ranging from 32 to 65 inches, the length of the sound bar body 20 is provided to correspond to the width of the 65-inch flat panel display apparatus 1. For example, the sound bar body 20 may be formed to have a length long enough to accommodate two sound transducer parts 30 longer than the width of the flat panel display apparatus 1. For example, the length L of the sound bar body 20 may be determined such that when a line bisecting the sound bar body 20 in the longitudinal direction is aligned with a line bisecting the flat panel display apparatus 1 in the widthwise direction, the left and right ends of the sound bar body 20 protrude by a predetermined length from both left and right sides of the flat panel display apparatus 1. At this time, the protruding length of the sound bar body 20 is appropriately determined so that the sound transducer part 30 can be disposed.

The sound bar body 20 may include an audio signal processor 21 (see, e.g., FIG. 4) and a plurality of terminals 27 and 28 (see, e.g., FIG. 4). The plurality of terminals 27 and 28 are provided on the top surface of the sound bar body 20. The plurality of terminals 27 and 28 may be provided in a straight line in the longitudinal direction of the sound bar body 20. Each of the plurality of terminals 27 and 28 includes a positive (+) terminal 27-1 and 28-1 and a negative (−) terminal 27-2 and 28-2.

In addition, the plurality of terminals 27 and 28 are symmetrically provided on opposite side end portions of the sound bar body 20. In detail, a plurality of left terminals 27 are provided near the left end of the sound bar body 20, and a plurality of right terminals 28 are provided near the right end of the sound bar body 20. At this time, the plurality of left terminals 27 and the plurality of right terminals 28 are provided in the same number. For example, when the left terminals 27 include three terminals, the right terminals 28 also include three terminals. In the present embodiment, the sound bar body 20 includes three left terminals 27 and three right terminals 28 so that the sound bar apparatus 10 may be applied to three models of the flat panel display apparatuses 1.

The interval between the plurality of terminals 27 and 28 may be determined according to the difference in width of the plurality of flat panel display apparatuses 1 to which the sound bar apparatus 10 is applied. For example, the left and right outermost terminals 27*a* and 28*a* may be set to fit in the 65-inch flat panel display apparatus, the left and right middle terminals 27*b* and 28*b* may be set to fit in the 55-inch flat panel display apparatus, and the left and right innermost terminals 27*c* and 28*c* may be set to fit in the 48-inch flat panel display apparatus. The plurality of terminals 27 and 28 may be formed of an electric conductor.

The audio signal processor 21, an amplifier 23, and a power supply 22 (see, e.g., FIG. 4) may be provided inside the sound bar body 20.

Referring to FIG. 4, the audio signal processor (e.g., including processing circuitry) 21 processes an audio signal output from an external input device, for example, the flat panel display apparatus 1, and transmits the processed audio signal to the amplifier 23. Therefore, the sound bar body 20 is provided with an input terminal 11 through which an external signal is input. The audio signal processor 21 is the same as or similar to the audio signal processor used in the conventional sound bar 5 (see FIG. 1); therefore, a detailed description thereof is omitted.

The amplifier 23 amplifies the audio signal output from the audio signal processor 21 and outputs the amplified audio signal to the plurality of terminals 27 and 28. The plurality of terminals 27 and 28 are electrically connected to the amplifier 23. In detail, the plurality of terminals 27 and 28 are connected in parallel in the longitudinal direction of the sound bar body 20 to the signal lines 23-1 and 23-2 coming out of the amplifier 23, respectively. In other words, the + output line 23-1 and the − output line 23-2 of the amplifier 23 are connected in parallel to the + terminal 27-1 and 28-1 and the − terminal 27-2 and 28-2 of each of the plurality of terminals 27 and 28. In addition, the amplifier 23 divides the audio signal and outputs the divided audio signals to the plurality of left terminals 27 and the plurality of right terminals 28. The amplifier 23 is the same as or similar to the amplifier used in the conventional sound bar 5; therefore, a detailed description thereof is omitted.

The power supply 22 supplies power to the audio signal processor 21 and the amplifier 23 and may be, for example, and without limitation, a switching mode power supply (SMPS), a DC rectifier device, a DC constant voltage device, or the like. As another example, the sound bar body 20 may be configured so that power is supplied to the audio signal processor 21 and the amplifier 23 using a DC adapter provided in the outside of the sound bar body 20 without providing the power supply 22 inside the sound bar body 20. The power supply 22 may be provided with an input terminal 12 through which external power is provided.

The sound transducer part 30 is detachably disposed to the sound bar body 20 described above. When the sound transducer part 30 is disposed on the top surface of the sound bar body 20, the sound transducer part 30 is positioned substantially perpendicular to the sound bar body 20. In addition, the sound transducer part 30 is formed to be detachably coupled to one of the plurality of terminals 27 and 28 provided in the sound bar body 20.

Referring to FIG. 5, the sound transducer part 30 may include a sound transducer 31 and an enclosure 33.

The enclosure 33 surrounds the sound transducer 31 and forms the outer appearance of the sound transducer part 30. As illustrated in FIGS. 5 and 6, a connection terminal 35 is provided on the bottom surface of the enclosure 33 and the connection terminal 35 includes a + connection terminal 35-1 and a − connection terminal 35-2. The + connection terminal 35-1 and the − connection terminal 35-2 are connected to the sound transducer 31. In addition, the + connection terminal 35-1 and the − connection terminal 35-2 of the enclosure 33 are formed to correspond to the + terminal 27-1 and 28-1 and the − terminal 27-2 and 28-2 of the plurality of terminals 27 and 28 of the sound bar body 20 described above. Accordingly, when the + connection terminal 35-1 and the – connection terminal 35-2 of the sound transducer part 30 are connected to the + terminal 27-1 and 28-1 and the – terminal 27-2 and 28-2 of the sound bar body 20, the audio signal output from the amplifier 23 is reproduced through the sound transducer 31.

The sound transducer 31 receives the audio signal transmitted from the sound bar body 20 through the connection terminals 35 provided at the bottom surface of the enclosure 33 and reproduces sound. In the present embodiment, one sound transducer 31 that can reproduce sounds from a low-frequency range to a high-frequency range is used.

Figure 7:
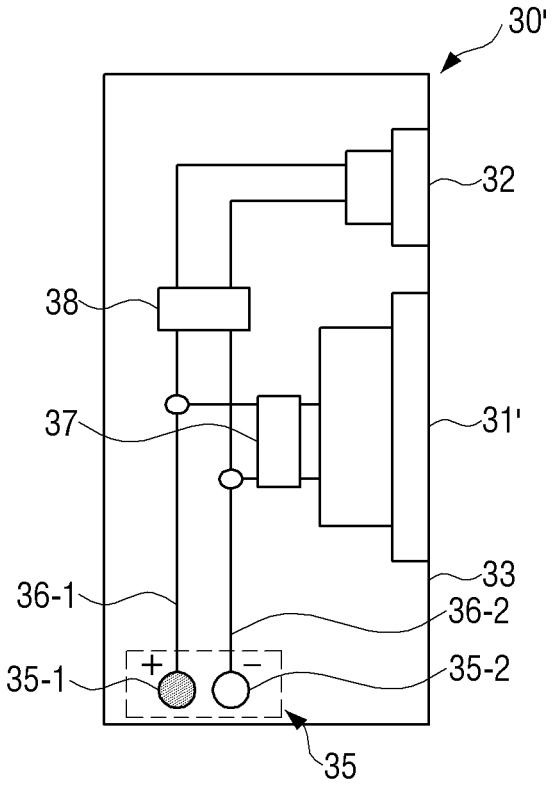
FIG. 7 is a cross-sectional view illustrating an example sound transducer part of a sound bar apparatus having a detachable sound transducer according to another example embodiment of the present disclosure.

As another example, with reference to FIG. 7, a sound transducer part 30' may include two sound transducers, that is, a sound transducer for a mid-frequency range 31' and a sound transducer for a high-frequency range 32.

FIG. 7 is a cross-sectional view illustrating an example sound transducer part of a sound bar apparatus having a detachable sound transducer according to an example embodiment of the present disclosure.

Referring to FIG. 7, the sound transducer part 30' according to an example embodiment of the present disclosure may include a sound transducer for a mid-frequency range 31', a sound transducer for a high-frequency range 32, two crossover networks 37 and 38, an enclosure 33, and a connection terminal 35.

The enclosure 33 is formed to surround the sound transducer for a mid-frequency range 31' and the sound transducer for a high-frequency range 32, and is provided with one connection terminal 35 on the bottom surface of the enclosure 33. The connection terminal 35 includes a + connection terminal 35-1 and a – connection terminal 35-2. The sound transducer for a mid-frequency range 31' and the sound transducer for a high-frequency range 32 are connected in parallel to the + connection terminal 35-1 and the – connection terminal 35-2 via the signal lines 36-1 and 36-2.

In addition, a crossover network (e.g., including crossover circuitry) for the mid-frequency range 37 is provided between the connection terminal 35 and the sound transducer for a mid-frequency range 31', and a crossover network for the high-frequency range 38 is provided between the connection terminal 35 and the sound transducer for a high-frequency range 32. Accordingly, the audio signal input through the connection terminal 35 is divided into a high-frequency signal and a mid-frequency signal through the crossover networks 37 and 38, and reproduced through the sound transducer for a high-frequency range 32 and the sound transducer for a mid-frequency range 31'. Here, the sound transducer for a high-frequency range 32 may include a tweeter, and the sound transducer for a mid-frequency range 31' may include a midrange.

The sound transducer part 30 is fixed to the sound bar body 20 so that the sound transducer part 30 is not separated from the sound bar body 20 when sound is reproduced by the sound transducer part 30. A fixing device (coupler) may be used to fix the sound transducer part 30 to the sound bar body 20. The fixing device may be implemented in various fixing manners.

As one example, the plurality of terminals 27 and 28 of the sound bar body 20 are formed of a conductive magnet, and the connection terminal 35 of the sound transducer part 30 is formed of a conductive metal material that can be attached to the magnet. Thus, when the connection terminal 35 of the sound transducer part 30 is attached to one of the plurality of terminals 27 and 28 of the sound bar body 20, the sound transducer part 30 is fixed to the sound bar body 20 by the magnetic force. At this time, the audio signal is transmitted to the sound transducer 31 through one of the terminals 27 and 28 of the sound bar body 20 and the connection terminal 35 of the sound transducer part 30, which are in contact with each other.

As another example, the plurality of terminals 27 and 28 of the sound bar body 20 may be made of a metal material which is conductive and can be attached to the magnet, and the connection terminal 35 of the sound transducer part 30 may be formed of a conductive magnet.

When one of the connection terminal 35 of the sound transducer part 30 and the plurality of terminals 27 and 28 of the sound bar body 20 is formed of a magnet, the plurality of terminals 27 and 28 of the sound bar body 20 may be formed to be flush with the top surface of the sound bar body 20. In other words, the plurality of terminals 27 and 28 may be provided not to protrude from or be concave on the top surface of the sound bar body 20. Also, the connection terminal 35 of the sound transducer part 30 may be formed to be flush with the bottom surface of the enclosure 33.

As another example, the plurality of terminals 27 and 28 of the sound bar body 20 may be formed to be convex or concave, and the connection terminal 35 of the sound transducer part 30 corresponding to the plurality of terminals 27 and 28 may be formed to be concave or convex, so that the sound bar body 20 and the sound transducer part 30 can be coupled by an insertion-coupling manner.

As another example, without using the plurality of terminals 27 and 28 of the sound bar body 20 and the connection terminal 35 of the sound transducer part 30, a separate fixing device (not illustrated) may be used to couple the sound bar body 20 and the sound transducer part 30. As the fixing device, various manners may be used as long as the sound transducer part 30 can be fixed to the sound bar body 20, such as a magnet manner, a one-touch manner, an insertion manner, or the like.

In FIG. 7, the audio signal is transmitted to the sound transducer for a mid-frequency range 31' and the sound transducer for a high-frequency range 32 through the one connection terminal 35. However, as another example, the sound bar apparatus may be configured to transmit audio signals to the sound transducer for a mid-frequency range and the sound transducer for a high-frequency range using a separate connection terminal.

Figure 8:
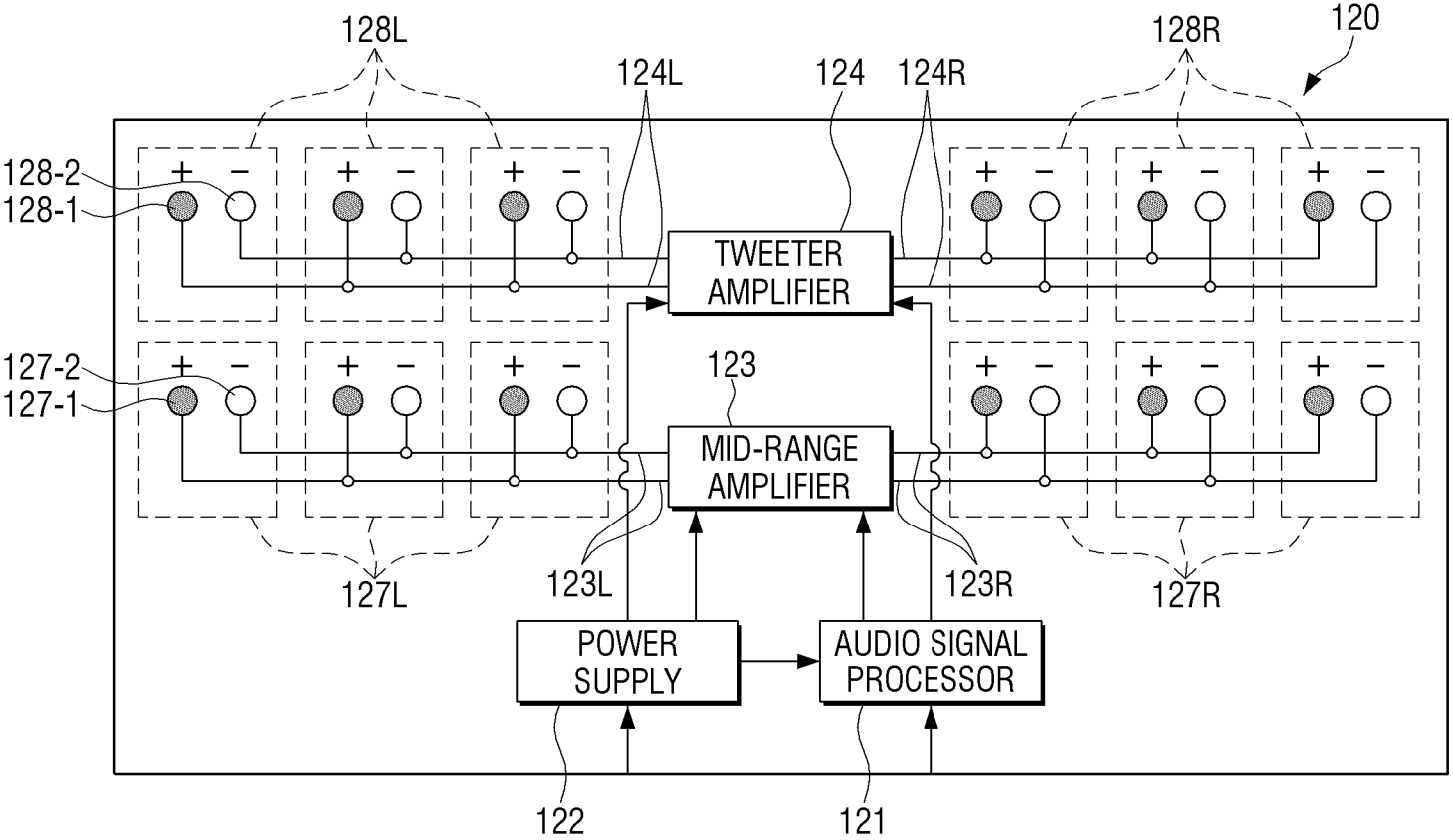
FIG. 8 is a block diagram illustrating an example sound bar body of a sound bar apparatus having a detachable sound transducer according to another example embodiment of the present disclosure.
Figure 9:
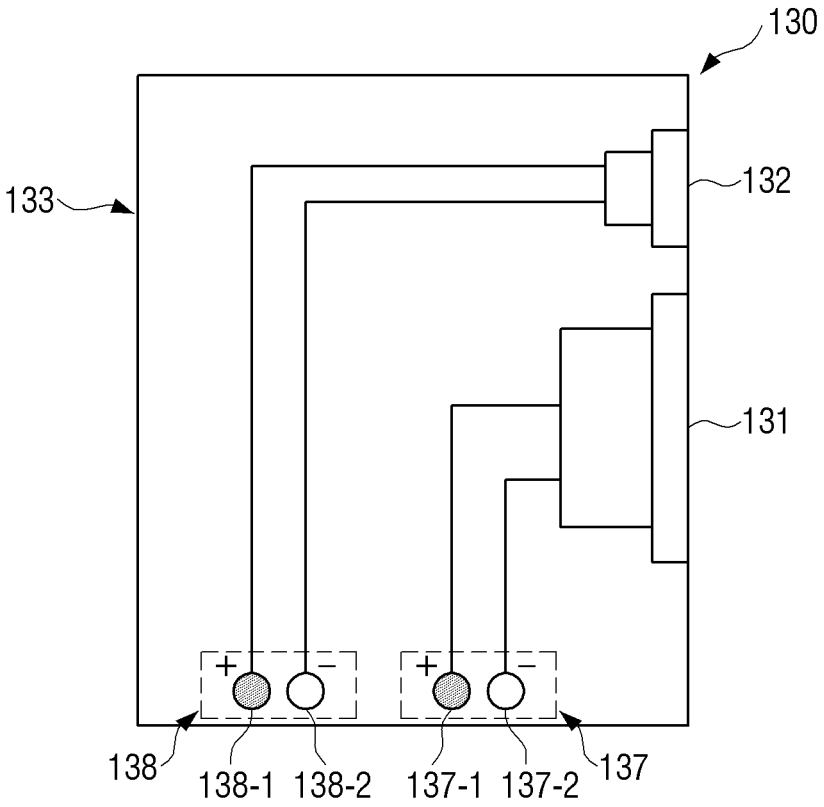
FIG. 9 is a cross-sectional view illustrating an example sound transducer part of a sound bar apparatus having a detachable sound transducer according to another example embodiment of the present disclosure.
Figure 10:
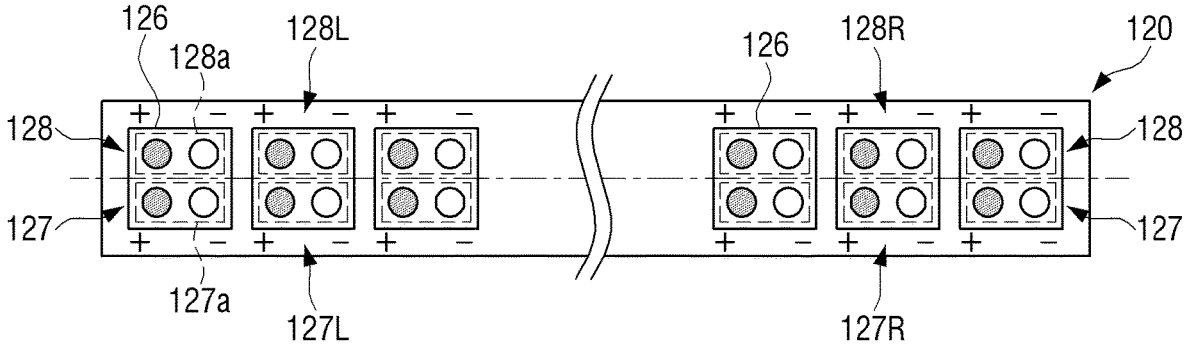
FIG. 10 is a plan view illustrating an example sound bar body of a sound bar apparatus having a detachable sound transducer according to another example embodiment of the present disclosure.

FIG. 8 is a block diagram of a sound bar body of an example sound bar apparatus having a detachable sound transducer according to another example embodiment of the present disclosure, and FIG. 9 is a cross-sectional view illustrating an example sound transducer part of a sound bar apparatus having a detachable sound transducer according to another example embodiment of the present disclosure. FIG. 10 is a plan view illustrating an example sound bar body of a sound transducer of a sound bar apparatus having a detachable sound transducer according to another example embodiment of the present disclosure.

Referring to FIGS. 8 to 10, a sound bar apparatus 10 having a detachable sound transducer according to an example embodiment of the present disclosure may include a sound bar body 120 and two sound transducer parts 130.

The sound bar body 120 is similar in shape to the sound bar body 20 according to the embodiment illustrated in FIG. 3 in that the sound bar body 120 is formed in a substantially rectangular parallelepiped shape having a narrow width, a long length, and, a low height. However, unlike the above-described embodiment, a plurality of terminals 127 and 128 are provided in two rows on the top surface of the sound bar body 120. The plurality of terminals 127 in the first row are provided to transmit an audio signal for the sound transducer for a mid-frequency range, and the plurality of terminals 128 in the second row are provided to transmit an audio signal for the sound transducer for a high-frequency range.

The terminals 127 in the first row include a plurality of left terminals 127L and a plurality of right terminals 127R. The terminals 128 in the second row include a plurality of left terminals 128L and a plurality of right terminals 128R. The plurality of terminals 127 and 128 comprising the first and second rows include a + terminal 127-1 and 128-1 and a – terminal 127-2 and 128-2, respectively. Therefore, the sound bar body 120 provides two terminals 127 and 128 for one sound transducer part 130.

Referring to FIG. 8, the sound bar body 120 may be provided with an audio signal processor (e.g., including processing circuitry) 121, a mid-range amplifier 123, a tweeter amplifier 124, and a power supply 122 therein.

The audio signal processor 121 and the power supply 122 are the same as or similar to those in the above-described embodiment; therefore, detailed descriptions thereof are not repeated.

The mid-range amplifier 123 amplifies the audio signal for the mid-frequency range output from the audio signal processor 121. The mid-range amplifier 123 is connected in parallel to the plurality of terminals 127 in the first row. In detail, a left audio signal line 123L extending from the mid-range amplifier 123 is connected in parallel to the plurality of left terminals 127L in the first row, and a right audio signal line 123R is connected in parallel to the plurality of right terminals 127R in the first row. Therefore, the plurality of terminals 127 in the first row include mid-range terminals.

The tweeter amplifier 124 amplifies the audio signal for the high-frequency range output from the audio signal processor 121. The tweeter amplifier 124 is connected in parallel to the plurality of terminals 128 in the second row. In detail, a left audio signal line 124L extending from the tweeter amplifier 124 is connected in parallel to the plurality of left terminals 128L in the second row, and a right audio signal line 124R is connected in parallel to the plurality of right terminals 128R in the second row. Therefore, the plurality of terminals 128 in the second row include tweeter terminals.

The other configuration of the sound bar body 120 is the same as or similar to that of the sound bar body 20 according to the above-described embodiment; therefore, a detailed description thereof is omitted.

Referring to FIG. 9, the sound transducer part (or housing) 130 is detachably disposed on the sound bar body 120 described above. The sound transducer part 130 may be formed to be detachably coupled to two terminals of a pair among the plurality of terminals 127 and 128 in two rows provided on the sound bar body 120.

The sound transducer part 130 may include a sound transducer for a mid-frequency range 131, a sound transducer for a high-frequency range 132, and an enclosure 133.

The enclosure 133 surrounds the sound transducer for a mid-frequency range 131 and the sound transducer for a high-frequency range 132 and forms an outer appearance of the sound transducer part 130. Two connection terminals, that is, a first connection terminal 137 and a second connection terminal 138 are provided in the bottom surface of the enclosure 133. Each of the connection terminals 137 and 138 includes a + connection terminal 137-1 and 138-1 and a – connection terminal 137-2 and 138-2. The first connection terminal 137 is connected to the sound transducer for a mid-frequency range 131, and the second connection terminal 138 is connected to the sound transducer for a high-frequency range 132.

In addition, the first and second connection terminals 137 and 138 of the enclosure 133 are formed to correspond to the plurality of terminals 127 and 128 in two rows of the sound bar body 120 described above. In detail, the first connection terminal 137 of the sound transducer part 130 is formed to be connectable to one of the plurality of terminals 127 in the first row of the sound bar body 120, and the second connection terminal 138 is formed to be connectable to one of the plurality of terminals 128 in the second row of the sound bar body 120. Accordingly, the first connection terminal 137 constitutes a mid-range connection terminal connected to the sound transducer for a mid-frequency range 131, and the second connection terminal 138 constitutes a tweeter connection terminal connected to the sound transducer for a high-frequency range 132.

Therefore, when the first connection terminal 137 and the second connection terminal 138 of the sound transducer part 130 are connected to the terminals 127 in the first row and the terminals 128 in the second row of the sound bar body 120, the audio signal of the mid-frequency range output from the mid-range amplifier 123 is reproduced through the sound transducer for a mid-frequency range 131, and the audio signal of the high-frequency range output from the tweeter amplifier 124 is reproduced through the sound transducer for a high-frequency range 132.

As described above, on the top surface of the sound bar body 120 including the mid-range amplifier 123 and the tweeter amplifier 124, two terminals 127 and 128 are provided for one sound transducer part 130 as illustrated in FIG. 10.

In the sound bar body 120 illustrated in FIG. 10, six mounting seats 126 are provided by three on the left and right sides. The sound transducer part 130 may be disposed on each of the mounting seats 126. Two terminals 127*a* and 128*a* are provided on the mounting seats 126 for the sound transducer part of the sound bar body 120. One terminal 128*a* is connected to the sound transducer for a high-frequency range 132 of the sound transducer part 130, and the other terminal 127*a* is connected to the sound transducer for a mid-frequency range 131 of the sound transducer part 130. Each of the terminals 127*a* and 128*a* includes a + terminal and a – terminal.

At this time, it is necessary to prevent the sound transducer part 130 from being disposed on the sound bar body 120 in the opposite direction.

Figure 11A:
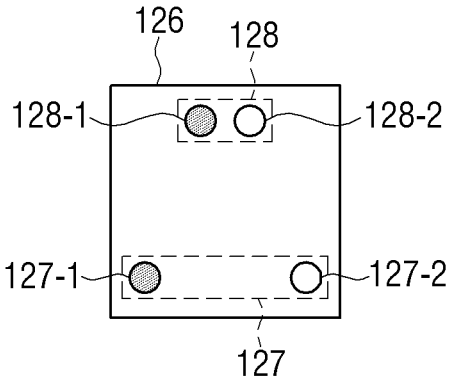
FIGS. 11A, 11B, and 11C are diagrams illustrating an example mounting seat of the sound bar body of the sound bar apparatus having a detachable sound transducer of FIG. 10.
Figure 11B:
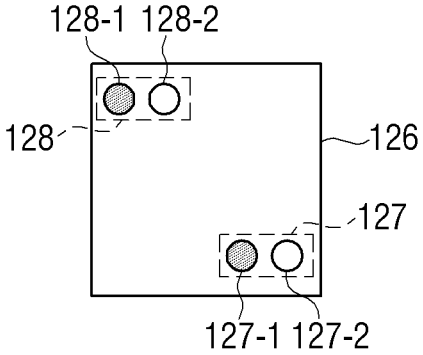
Figure 11C:
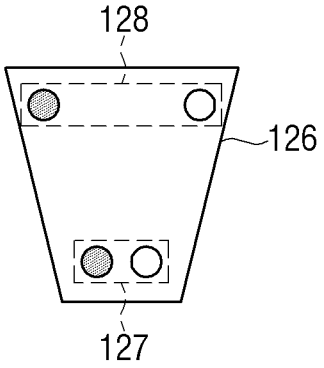

FIGS. 11A, 11B, and 11C are views illustrating example mounting seats of the sound bar body of a sound bar apparatus having a detachable sound transducer of FIG. 10.

In order to prevent the sound transducer part 130 from being erroneously disposed on the mounting seats 126 of the sound bar body 120, the arrangement of the two terminals 127 and 128 may be different from each other as illustrated in FIG. 11A. For example, the interval between the + terminal 127-1 and the – terminal 127-2 of the terminal 127 in the first row is set to be larger than the interval between the + terminal 128-1 and the – terminal 128-2 of the terminal 128 in the second row.

Alternatively, as illustrated in FIG. 11B, the terminal 127 in the first row and the terminal 128 in the second row may be arranged diagonally. In this case, the interval between the + terminal 127-1 and the – terminal 127-2 of the terminal 127 in the first row may be equal to the interval between the + terminal 128-1 and the – terminal 128-2 of the terminal 128 in the second row.

Alternatively, mechanical mounting guides may be provided in the mounting seats 126 of the sound bar body 120 and the sound transducer part 130. For example, as illustrated in FIG. 11C, a groove 126 having a trapezoidal shape may be provided in the sound bar body 120, and two terminals 127 and 128 may be provided in the groove 126. At this time, a trapezoidal protrusion (not illustrated) which is inserted into the groove 126 having the trapezoidal shape of the sound bar body 120 may be provided on the bottom surface of the sound transducer part 130. However, the mounting guides of the sound bar body 120 and the sound transducer part 130 are not limited thereto, and may be provided in various shapes.

In addition, it is possible to print a mark indicating the mounting direction on the sound bar body 120 and the sound transducer part 130 in order to prevent the sound transducer part 130 from being erroneously mounted on the sound bar body 120.

On the other hand, the sound bar apparatus 10 having the detachable sound transducer according to an embodiment of the present disclosure as described above may be configured to connect a sound transducer for a low-frequency range, that is, a woofer speaker.

Figure 12:
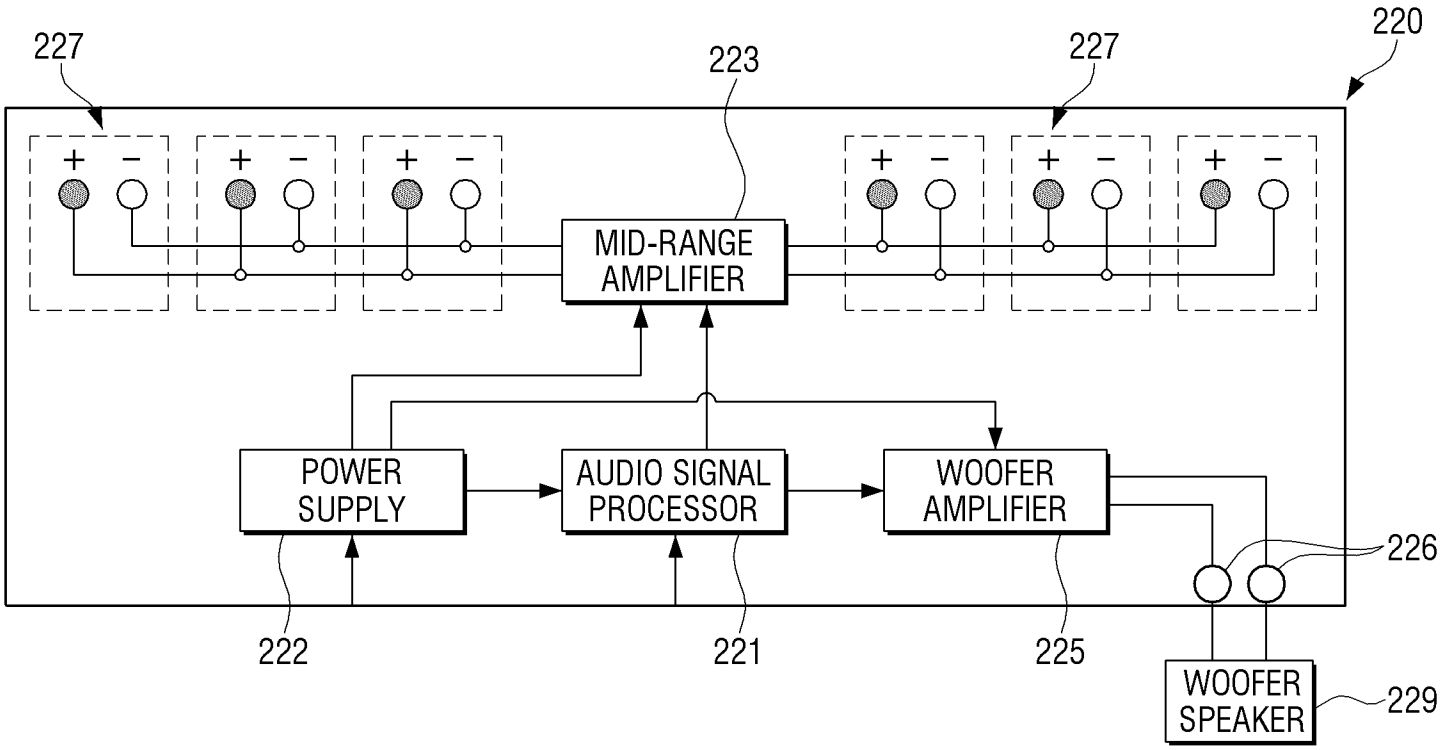
FIG. 12 is a block diagram illustrating an example sound bar body of a sound bar apparatus having a detachable sound transducer according to another example embodiment of the present disclosure.

FIG. 12 is a block diagram illustrating an example sound bar body of a sound bar apparatus having a detachable sound transducer according to another example embodiment of the present disclosure.

Referring to FIG. 12, a sound bar body 220 may be provided with an audio signal processor (e.g., including processing circuitry) 221, a mid-range amplifier 223, a woofer amplifier 225, and a power supply 222.

The sound bar body 220 as illustrated in FIG. 12 has a structure in which the woofer amplifier 225 is added to the sound bar body 20 as illustrated in FIG. 4. Therefore, the audio signal processor 221, the mid-range amplifier 223, and the power supply 222 of the sound bar body 220 of FIG. 12 are the same as or similar to the audio signal processor 21, the mid-range amplifier 23, and the power supply 22 of the sound bar body 20 of FIG. 4. Also, a plurality of terminals 227 are provided on the top surface of the sound bar body 220, which is the same as the above-described sound bar body 20 of FIG. 4.

The woofer amplifier 225 is connected to the audio signal processor 221 and woofer terminals 226 provided on one side surface of the sound bar body 220. The woofer amplifier 225 receives power from the power supply 222.

The woofer amplifier 225 amplifies the low-frequency range audio signal output from the audio signal processor 21 and transmits the amplified audio signal to the woofer terminals 226. A connection terminal of a woofer speaker 229 provided separately from the sound transducer part 30 (see FIG. 3) of the present disclosure may be connected to the woofer terminals 226. The woofer speaker 229 is based on the prior art; therefore, a detailed description thereof is omitted.

Figure 13:
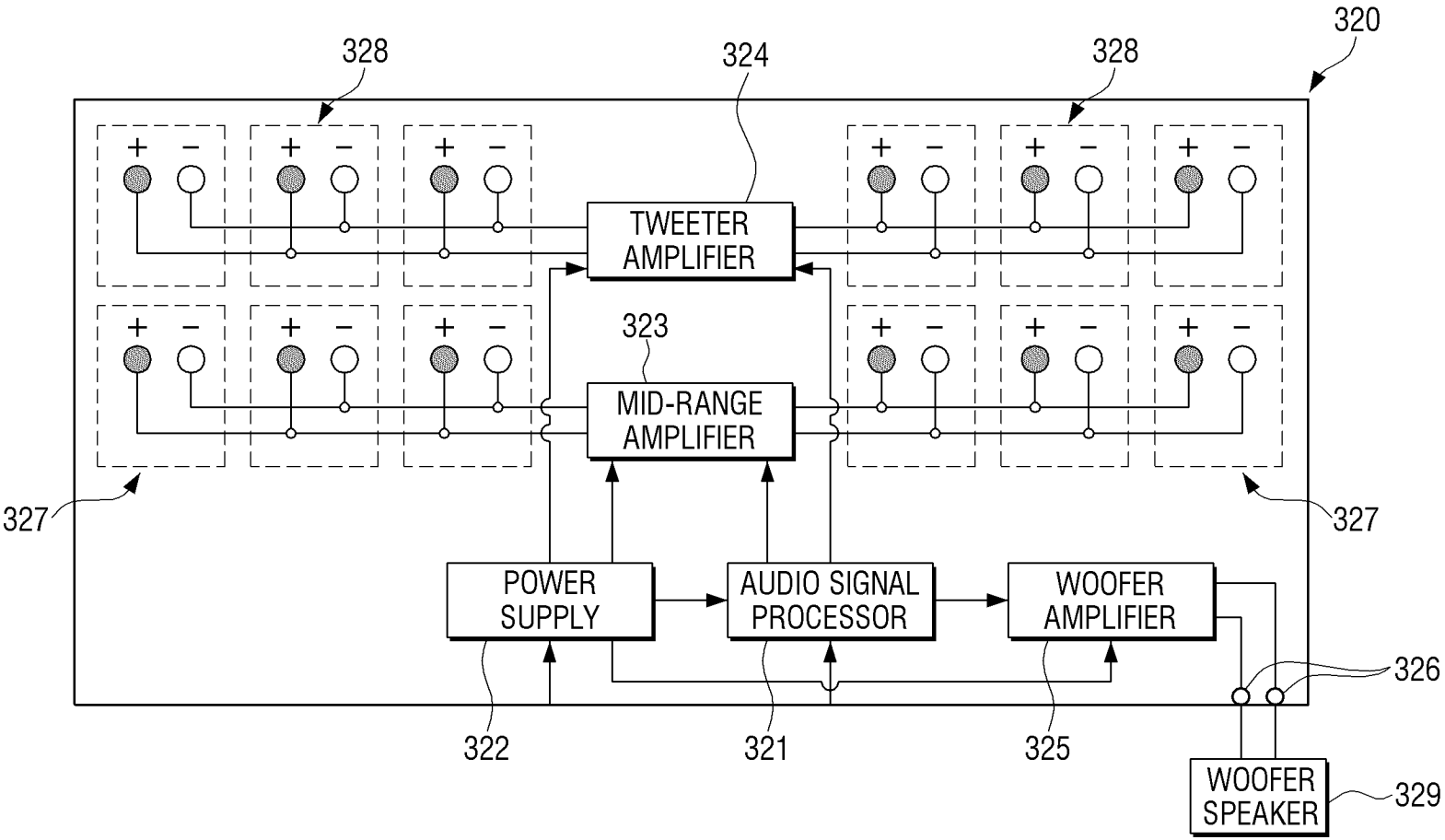
FIG. 13 is a block diagram illustrating an example sound bar body of a sound bar apparatus having a detachable sound transducer according to another example embodiment of the present disclosure.

FIG. 13 is a functional block diagram illustrating an example sound bar body of a sound bar apparatus having a detachable sound transducer according to another example embodiment of the present disclosure.

Referring to FIG. 13, a sound bar body 320 may be provided with an audio signal processor (e.g., including processing circuitry) 321, a mid-range amplifier 323, a tweeter amplifier 324, a woofer amplifier 325, and a power supply 322.

The sound bar body 320 as illustrated in FIG. 13 has a structure in which the woofer amplifier 325 is added to the sound bar body 120 as illustrated in FIG. 8. Therefore, the audio signal processor 321, the tweeter amplifier 324, the mid-range amplifier 323, and the power supply 322 of the sound bar body 320 of FIG. 13 are the same as or similar to the audio signal processor 121, the tweeter amplifier 124, the mid-range amplifier 123, and the power supply 122 of the sound bar body 120 of FIG. 8. Also, a plurality of terminals 327 and 328 are provided on the top surface of the sound bar body 320, which is the same as the above-described sound bar body 120 of FIG. 8.

The woofer amplifier 325 is connected to the audio signal processor 321 and woofer terminals 326 provided on one side surface of the sound bar body 320. The woofer amplifier 325 receives power from the power supply 322.

The woofer amplifier 325 amplifies the low-frequency range audio signal output from the audio signal processor 321 and transmits the amplified audio signal to the woofer terminals 326. A connection terminal of a woofer speaker 329 provided separately from the sound transducer part 130 (see FIG. 9) of the present disclosure may be connected to the woofer terminals 326. The woofer speaker 329 is based on the prior art; therefore, a detailed description thereof is omitted.

Hereinafter, a method of installing a sound bar apparatus having a detachable sound transducer according to an example embodiment of the present disclosure in flat panel display apparatuses of various sizes will be described with reference to FIGS. 14A to 14F.

FIGS. 14A, 14B, 14C, 14D, 14E and 14F are diagrams illustrating example states in which a sound bar apparatus having a detachable sound transducer according to an example embodiment of the present disclosure is applied to flat panel display apparatuses of various sizes.

Figure 14A:
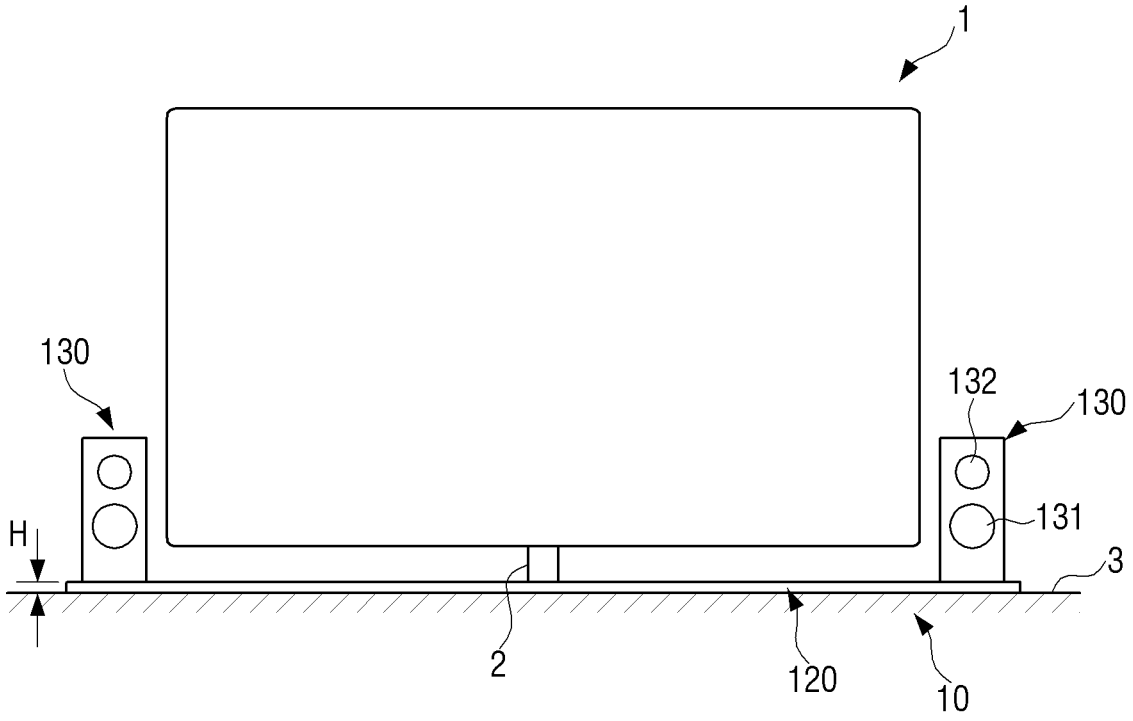
FIGS. 14A, 14B, 14C, 14D, 14E and 14F are diagrams illustrating various example states in which a sound bar apparatus having a detachable sound transducer according to an example embodiment of the present disclosure is applied to flat panel display apparatuses of different sizes.
Figure 14B:
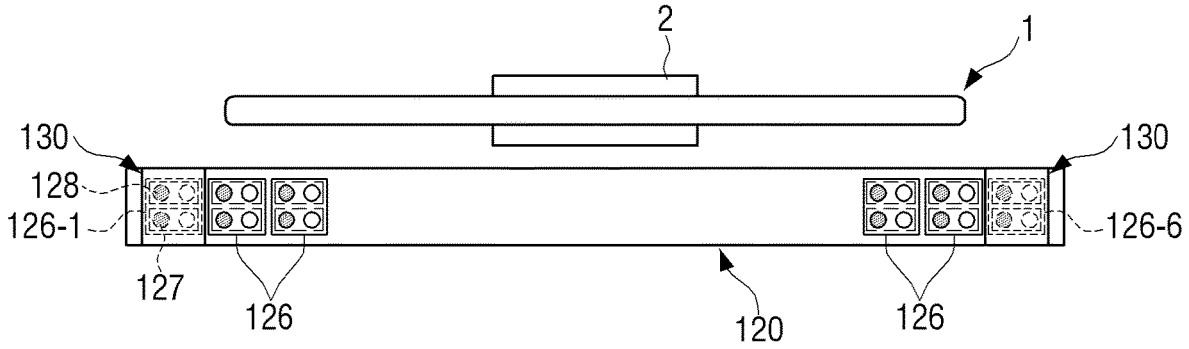

In detail, FIGS. 14A and 14B are views illustrating a case where a sound bar apparatus 10 having a detachable sound transducer according to an example embodiment of the present disclosure is disposed in the largest size flat panel display apparatus 1, for example, a 65-inch flat panel display apparatus 1.

Referring to FIGS. 14A and 14B, the sound bar body 120 is disposed in front of the flat panel display apparatus 1, that is, in front of a stand 2 of the flat panel display apparatus 1. At this time, the sound bar body 120 is disposed on the surface 3 where the flat panel display apparatus 1 is disposed. Since the height H of the sound bar body 120 is very low compared to the height of the conventional sound bar, the sound bar body 120 is not very noticeable.

Then, the user disposes two sound transducer parts 130 on the left and right sides of the sound bar body 120. At this time, since only the outermost mounting seats 126-1 and 126-6 of the plurality of mounting seats 126 provided in the sound bar body 120 project to the left and right sides of the flat panel display apparatus 1, the user disposes the two sound transducer parts 130 on the left outmost mounting seat 126-1 and the right outmost mounting seat 126-6 projecting to the outside of the flat panel display apparatus 1.

When the sound transducer part 130 is disposed at the mounting seats 126 of the sound bar body 120, the connection terminals 137 and 138 (see FIG. 9) of the sound transducer part 130 are electrically connected to the terminals 127 and 128 of the outermost mounting seats 126-1 and 126-6 of the sound bar body 120, so that the audio signal output from the sound bar body 120 is reproduced by the sound transducer for a mid-frequency range 131 and the sound transducer for a high-frequency range 132.

Figure 14C:
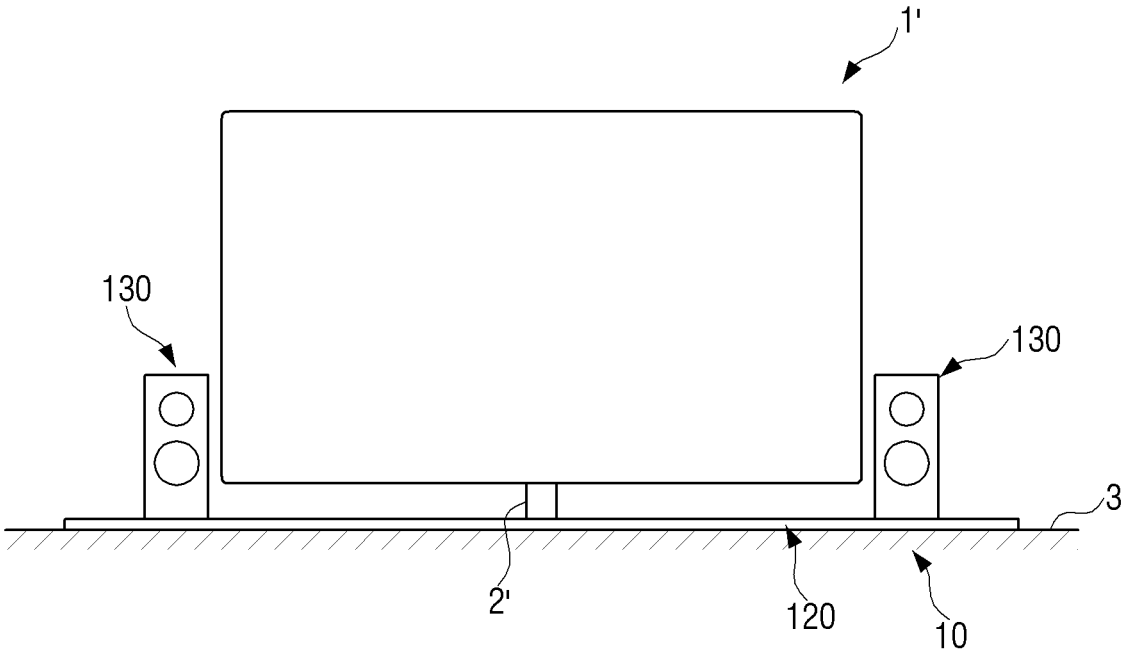
Figure 14D:
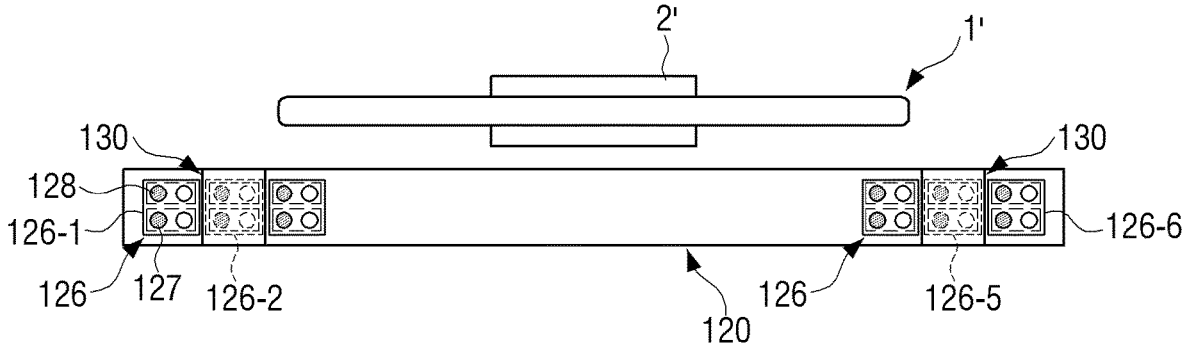

FIGS. 14C and 14D are views illustrating a case where the sound bar apparatus 10 having a detachable sound transducer according to an embodiment of the present disclosure is disposed in the medium size flat panel display apparatus 1', for example, a 55-inch flat panel display apparatus 1.

Referring to FIGS. 14C and 14D, the sound bar body 120 is disposed in front of the flat panel display apparatus 1', that is, in front of a stand 2' of the flat panel display apparatus 1'. Then, the user disposes two sound transducer parts 130 on the left and right sides of the sound bar body 120. At this time, the outermost mounting seats 126-1 and 126-6 and the middle mounting seats 126-2 and 126-5 of the plurality of mounting seats 126 provided in the sound bar body 120 project to the left and right sides of the flat panel display apparatus 1'. Accordingly, the user disposes the two sound transducer parts 130 on the left and right middle mounting seats 126-2 and 126-5 nearest to the left and right side surfaces of the flat panel display apparatus 1' among the mounting seats 126 projecting to the outside of the flat panel display apparatus 1'.

When the sound transducer parts 130 are disposed at the mounting seats 126 of the sound bar body 120, the connection terminals 137 and 138 of the sound transducer part 130 are electrically connected to the terminals 127 and 128 of the left and right middle mounting seats 126-2 and 126-5 of the sound bar body 120, so that the audio signal output from the sound bar body 120 is reproduced by the sound transducer parts 130.

Figure 14E:
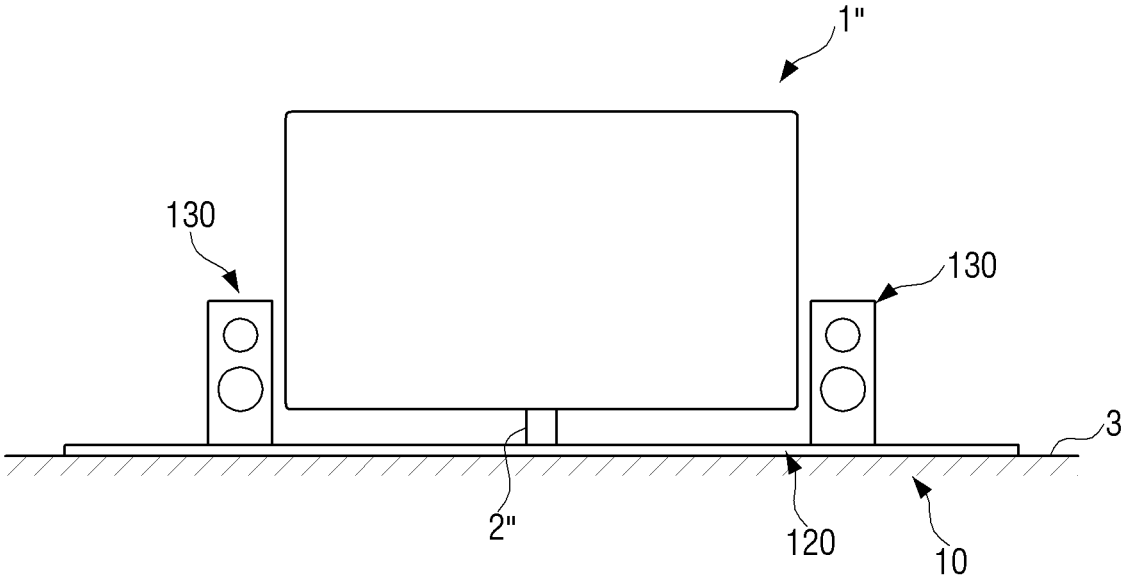
Figure 14F:
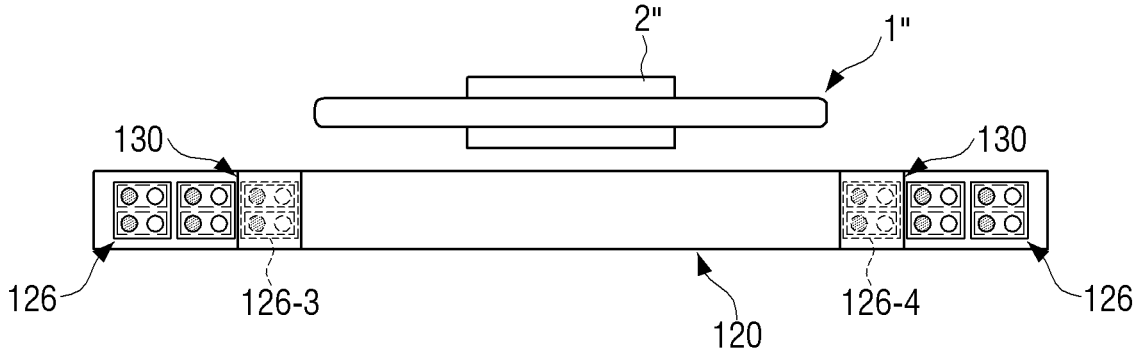

FIGS. 14E and 14F are views illustrating a case where the sound bar apparatus 10 having a detachable sound transducer according to an embodiment of the present disclosure is disposed in the smallest size flat panel display apparatus 1", for example, a 42-inch flat panel display apparatus 1".

Referring to FIGS. 14E and 14F, the sound bar body 120 is disposed in front of the flat panel display apparatus 1", that is, in front of a stand 2" of the flat panel display apparatus 1". Then, the user disposes two sound transducer parts 130 on the left and right sides of the sound bar body 120. At this time, all the plurality of mounting seats 126 provided in the sound bar body 120 project to the left and right sides of the flat panel display apparatus 1". Accordingly, the user disposes the two sound transducer parts 130 on the left and right mounting seats 126-3 and 126-4 nearest to the left and right side surfaces of the flat panel display apparatus 1" among the mounting seats 126 projecting to the outside of the flat panel display apparatus 1", that is, the mounting seats 126-3 and 126-4 located at the innermost of the plurality of mounting seats 126.

When the sound transducer parts 130 are disposed at the mounting seats 126 of the sound bar body 120, the connection terminals 137 and 138 of the sound transducer parts 130 are electrically connected to the terminals 127 and 128 of the left and right innermost mounting seats 126-3 and 126-4 of the sound bar body 120, so that the audio signal output from the sound bar body 120 is reproduced by the sound transducer part 130.

As described above, the sound bar apparatus 10 having a detachable sound transducer according to an embodiment of the present disclosure is configured such that the two sound transducer parts 130 can be disposed on the sound bar body 120 to correspond to the size of each of the flat panel display apparatuses 1, 1', and 1". Therefore, one sound bar apparatus 10 may be applied to the flat panel display apparatuses 1, 1', and 1" of various sizes.

In the above description, three mounting seats 126 are provided on the left and right sides of the sound bar body 120; however, the number of the mounting seats 126 is not limited thereto. The mounting seats 126 of the sound bar body 120 may be provided in two or four or more depending on the widths of the plurality of flat panel display apparatuses to which the sound bar apparatus 10 is to be applied.

In the above description, the length L of the sound bar body 20 and 120 is constant; however, the length of the sound bar body may be variable.

Hereinafter, a case where the sound bar body is configured in a telescopic manner will be described with reference to FIGS. 15 to 18.

Figure 15:
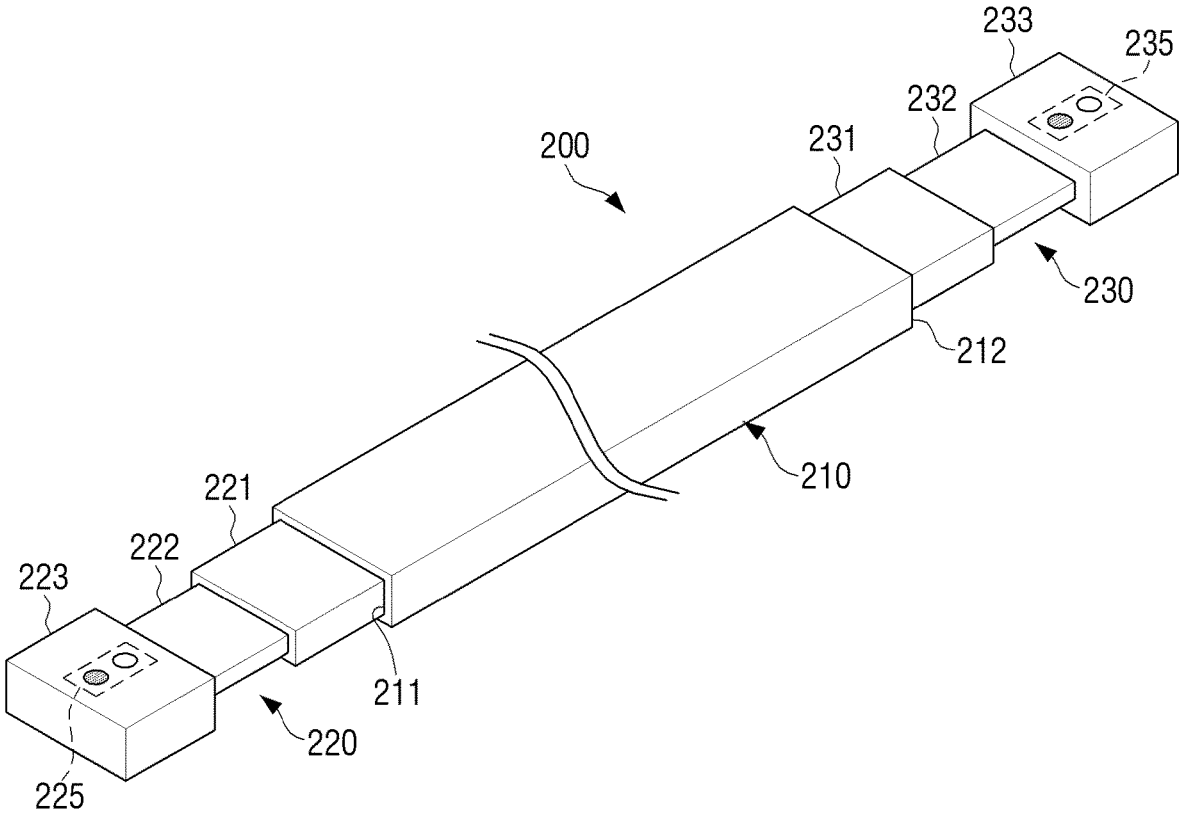
FIG. 15 is a perspective view illustrating another example sound bar body of a sound bar apparatus having a detachable sound transducer according to an example embodiment of the present disclosure.
Figure 16:
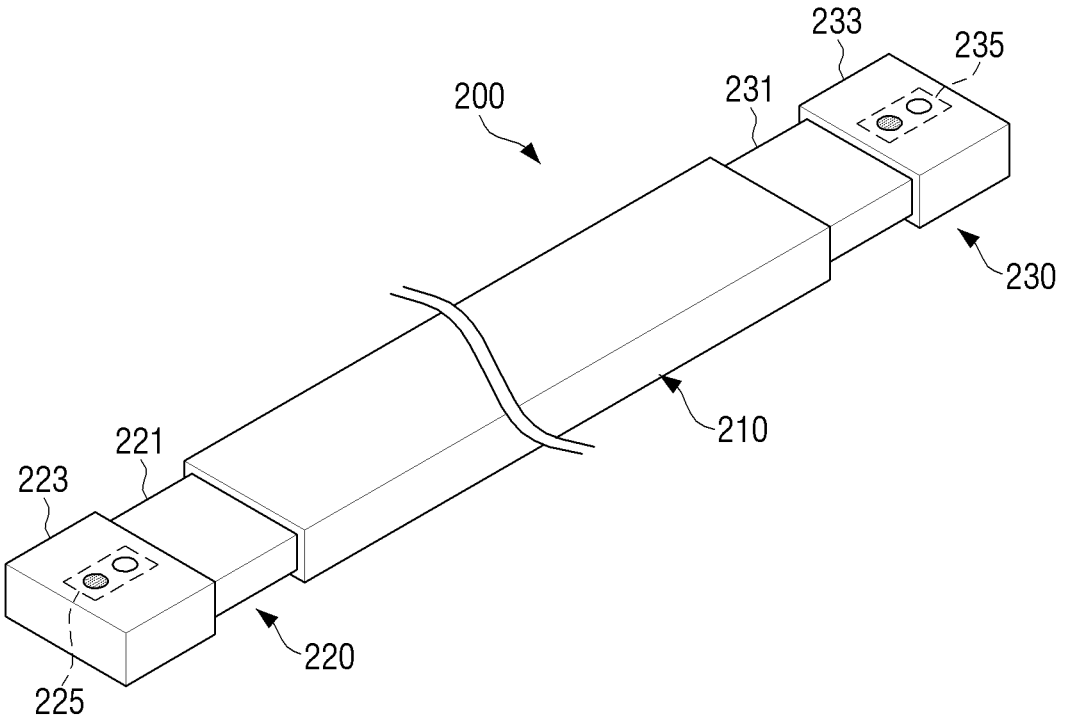
FIG. 16 is a perspective view illustrating an example state in which one stage of the sound bar body of FIG. 15 is folded.
Figure 17:
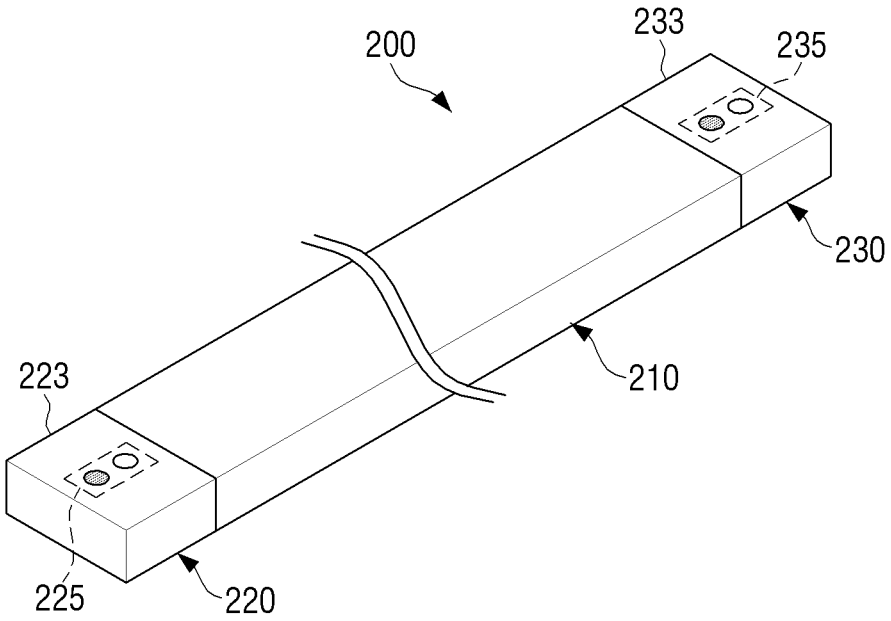
FIG. 17 is a perspective view illustrating an example state in which the sound bar body of FIG. 15 are completely folded.
Figure 18:
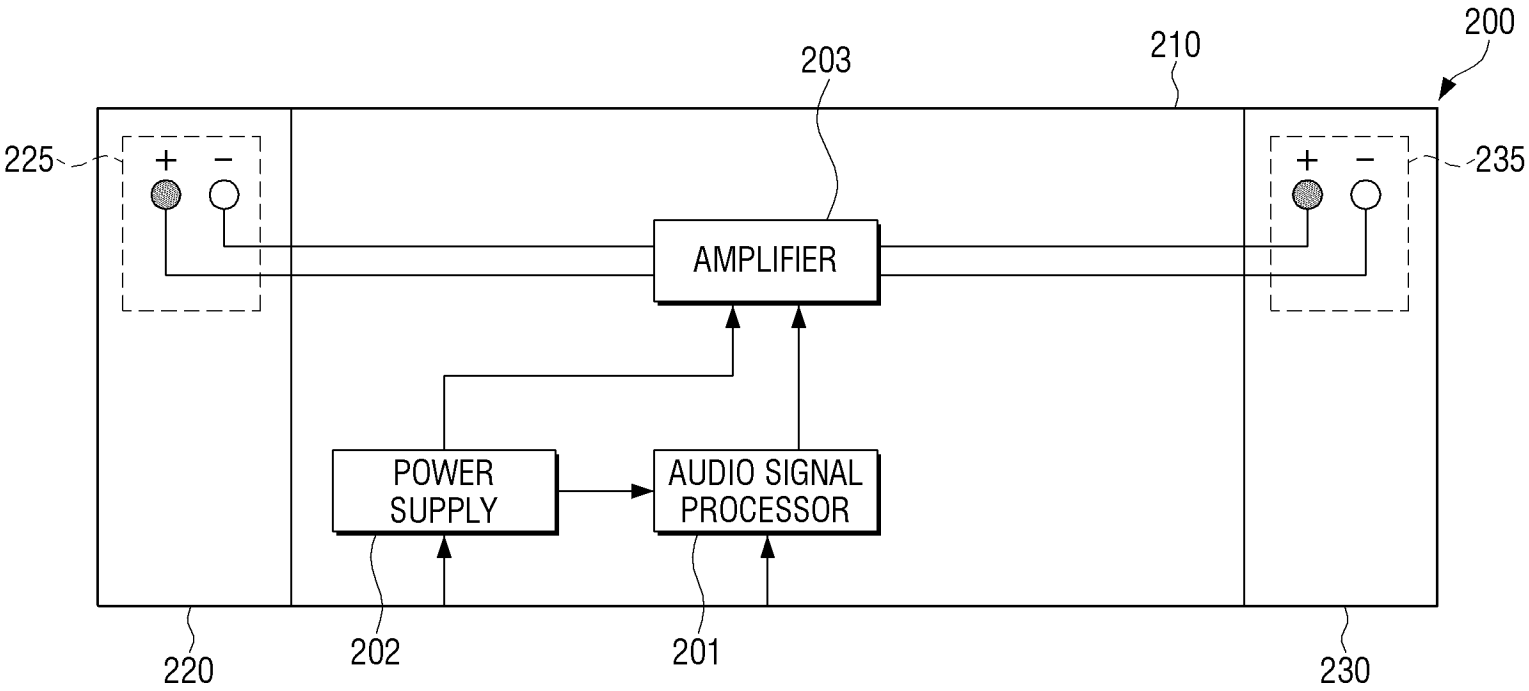
FIG. 18 is a block diagram illustrating another example sound bar body of a sound bar apparatus having a detachable sound transducer according to an example embodiment of the present disclosure.

FIG. 15 is a perspective view illustrating another example sound bar body of a sound bar apparatus having a detachable sound transducer according to an example embodiment of the present disclosure. FIG. 16 is a perspective view illustrating an example state in which one stage of the sound bar body of FIG. 15 is folded (e.g., retracted), and FIG. 17 is a perspective view illustrating an example state in which the sound bar body of FIG. 15 are completely folded (e.g., retracted). FIG. 18 is a block diagram illustrating another example of a sound bar body of a sound bar apparatus having a detachable sound transducer according to an example embodiment of the present disclosure.

Referring to FIG. 15, a sound bar body 200 used in a sound bar apparatus having a detachable sound transducer according to an example embodiment of the present disclosure may include a central portion 210, a left extension portion 220, and a right extension portion 230.

The central portion 210 may be formed in a substantially rectangular parallelepiped shape having a small height, a narrow width, and a long length. Left and right receiving portions 211 and 212 are provided at opposite ends of the central portion 210 to receive the left extension portion 220 and the right extension portion 230.

The left extension portion 220 is provided at the left end of the central portion 210, and includes at least two foldable (e.g., retractable into the central portion) extension members 221 and 222 and a terminal portion 223 provided with a terminal 225.

In the case of the sound bar body 200 as illustrated in FIG. 15, the left extension portion 220 includes two extension members, that is, a first extension member 221 and a second extension member 222 connecting the terminal portion 223 and the central portion 210. The first extension member 221 is formed to be inserted into the left receiving portion 211 of the central portion 210 or be pulled out of the left receiving portion 211, and the second extension member 222 is formed to be inserted into the first extension member 221 or be pulled out of the first extension member 221. When the second extension member 222 is inserted into the first extension member 221, and then the first extension member 221 is inserted into the left receiving portion 211, the terminal portion 223 comes into contact with the left end of the central portion 210.

The terminal portion 223 may be formed to have the same width and height as the central portion 210. The terminals 225 provided on the top surface of the terminal portion 223 may be connected to the connection terminal 35 of the sound transducer part 30 (see FIG. 3). The terminal 225 of the left terminal portion 223 may include a + terminal and a − terminal.

The right extension portion 230 is provided at the right end of the central portion 210, and includes at least two foldable (e.g., retractable into the central portion) extension members 231 and 232 and a terminal portion 233 provided with a terminal 235.

In the case of the sound bar body 200 as illustrated in FIG. 15, the right extension portion 230 includes two extension members, that is, a first extension member 231 and a second extension member 232 connecting the terminal portion 233 and the central portion 210. The first extension member 231 is formed to be inserted into the right receiving portion 212 of the central portion 210 or be pulled out of the right receiving portion 212, and the second extension member 232 is formed to be inserted into the first extension member 231 or be pulled out of the first extension member 231. When the second extension member 232 is inserted into the first extension member 231, and then the first extension member 231 is inserted into the right receiving portion 212, the terminal portion 233 comes into contact with the right end of the central portion 210.

The terminal portion 233 may be formed to have the same width and height as the central portion 210. The terminals 235 provided on the top surface of the terminal portion 233 may be connected to the connection terminal 35 of the sound transducer part 30 (see FIG. 3). The terminal 235 of the right terminal portion 233 may include a + terminal and a − terminal.

FIG. 15 illustrates an example state in which the sound bar body 200 is maximally extended, that is, a state in which the first and second extension members 221 and 222 of the left extension portion 220 are all pulled out and the first and second extension members 231 and 232 of the right extension portion 230 are all pulled out. Therefore, both the left terminal portion 223 and the right terminal portion 233 are farthest from the central portion 210. The sound bar body 200 in this state may be used in a flat panel display apparatus 1 of the maximum size.

FIG. 16 illustrates an example state in which the sound bar body 200 as illustrated in FIG. 15 is shortened by one stage, that is, a state in which the first extension member 221 of the left extension portion 220 is pulled out from the left receiving portion 211 and the second extension member 222 is inserted (e.g., retracted) into the first extension member 221. Also, the first extension member 231 of the right extension portion 230 is pulled out from the right receiving portion 212 and the second extension member 232 is inserted (e.g., retracted) into the first extension member 231. Accordingly, both the left terminal portion 223 and the right terminal portion 233 are spaced apart from the central portion 210 by the length of the first extension member 221 and 231. The sound bar body 200 in this state may be used in a flat panel display apparatus 1 of the medium size.

FIG. 17 illustrates an example state in which the length of the sound bar body 200 as illustrated in FIG. 15 is minimized, that is, a state in which both the first and second extension members 221 and 222 of the left extension portion 220 are inserted (e.g., retracted) into the left receiving portion 211 and the first and second extension members 231 and 232 of the right extension portion 230 are inserted (e.g., retracted) into the right receiving portion 212. Accordingly, both the left terminal portion 223 and the right terminal portion 233 are in contact with the left end and the right end of the central portion 210. The sound bar body 200 in this state may be used in a flat panel display apparatus 1 of the minimum size.

As illustrated in FIG. 18, an audio signal processor (e.g., including processing circuitry) 201, an amplifier 203, and a power supply 202 are provided in the central portion 210 of the sound bar body 200. The audio signal processor 201, the amplifier 203, and the power supply 202 of the sound bar body 200 according to an example embodiment of the present disclosure are the same as or similar to the audio signal processor 21, the amplifier 23, and the power supply 22 of the sound bar body 20 of FIG. 4 as described above; therefore, detailed descriptions thereof are omitted.

The amplifier 203 provided in the central portion 210 of the sound bar body 200 is electrically connected to terminals 225 and 235 provided on the left and right terminal portions 223 and 233.

Accordingly, when the sound transducer parts 30 (see FIG. 3) are provided on the terminal portions 223 and 233 of the sound bar body 200, the audio signal output from the sound bar body 200 is reproduced by the sound transducer parts 30.

Hereinafter, as another example, a sound bar body that can be adjusted in length using extension blocks will be described with reference to FIGS. 19 to 22.

Figure 19:
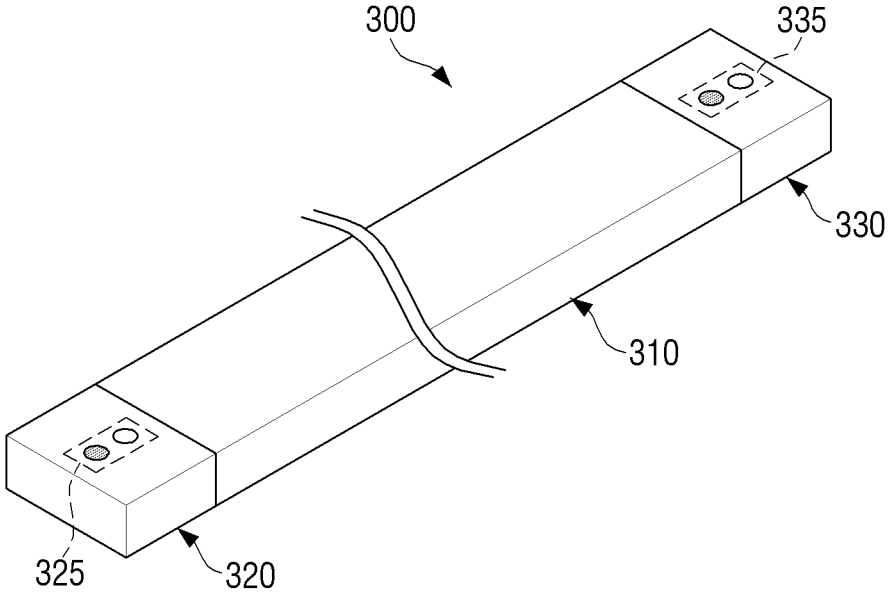
FIG. 19 is a perspective view illustrating another example sound bar body of a sound bar apparatus having a detachable sound transducer according to another example embodiment of the present disclosure.
Figure 20:
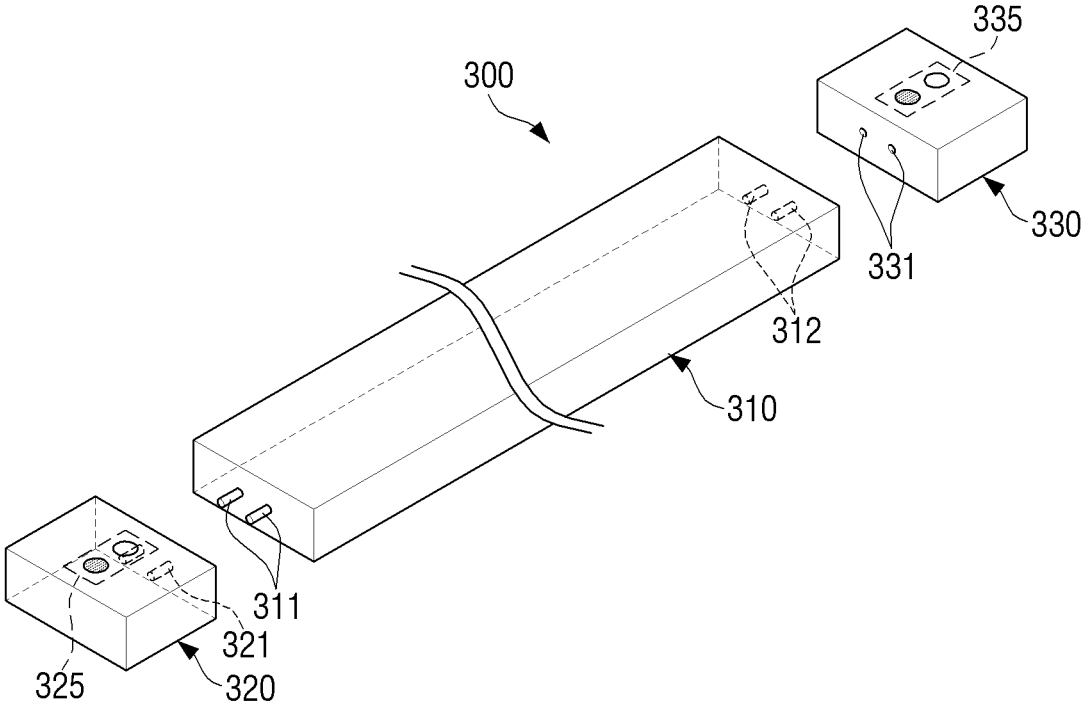
FIG. 20 is a perspective view illustrating an example state in which terminal blocks are separated from a center block of the sound bar body of the sound bar apparatus having a detachable sound transducer of FIG. 19.
Figure 21:
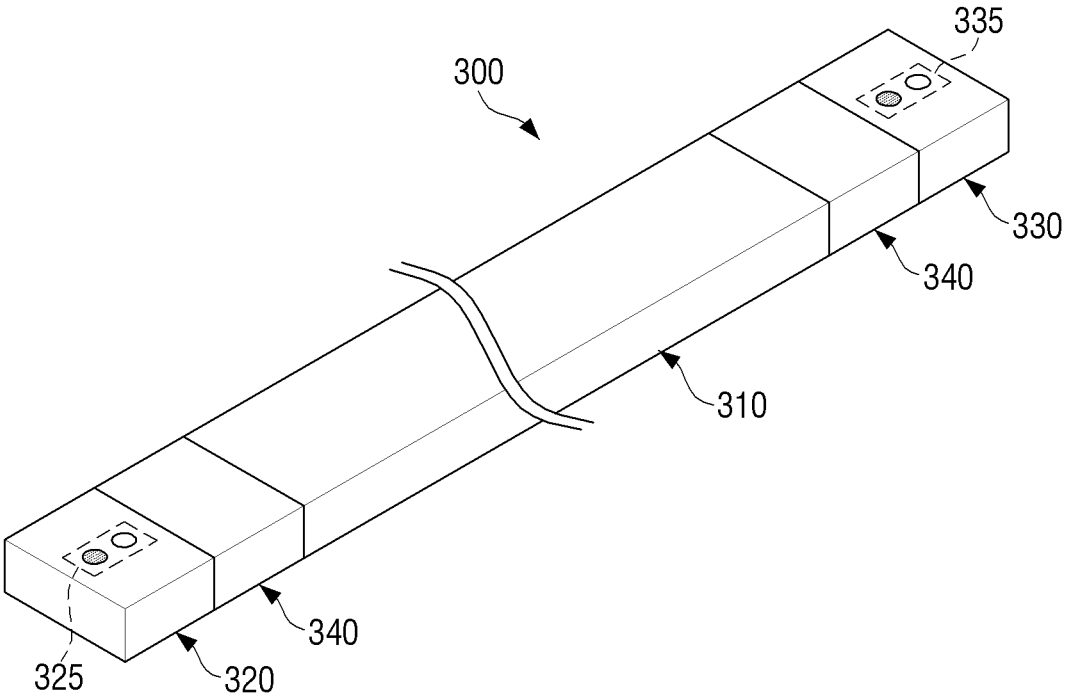
FIG. 21 is a perspective view illustrating an example state in which extension blocks are disposed in the sound bar body of the sound bar apparatus having a detachable sound transducer of FIG. 19.
Figure 22:
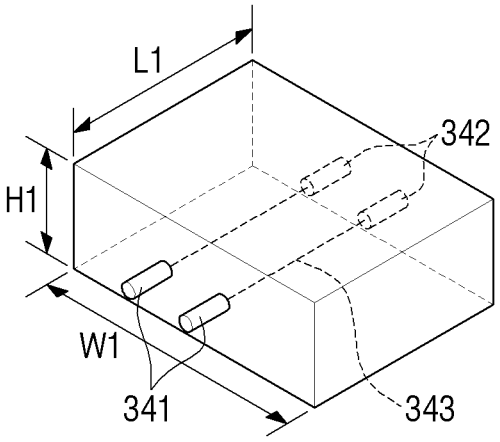
FIG. 22 is a perspective view illustrating an example extension block used in the sound bar apparatus having a detachable sound transducer of FIG. 19.

FIG. 19 is a perspective view illustrating another example of a sound bar body of a sound bar apparatus having a detachable sound transducer according to another example embodiment of the present disclosure. FIG. 20 is a perspective view illustrating a state in which terminal blocks are separated from a center block of the sound bar body of the sound bar apparatus having a detachable sound transducer of FIG. 19. FIG. 21 is a perspective view illustrating a state in which extension blocks are disposed in the sound bar body of the sound bar apparatus having a detachable sound transducer of FIG. 19. FIG. 22 is a perspective view illustrating an extension block used in the sound bar apparatus having a detachable sound transducer of FIG. 19.

Referring to FIGS. 19 and 20, a sound bar body 300, which can be used in a sound bar apparatus having a detachable sound transducer according to an example embodiment of the present disclosure, may include a center block 310 and a pair of terminal blocks 320 and 330.

The center block 310 may be formed in a substantially rectangular parallelepiped shape having a small height, a narrow width, and a long length. Two connecting protrusions 311 and 312 are provided at both ends of the center block 310. In detail, two left connecting protrusions 311 are provided at the left end of the center block 310, and two right connecting protrusions 312 are provided at the right end of the center block 310. The two left connecting protrusions 311 and the two right connecting protrusions 312 may be formed of an electrical conductor.

An audio signal processor, an amplifier, and a power supply may be provided inside the center block 310. The audio signal processor, the amplifier, and the power supply provided in the center block 310 of the sound bar body 300 according to the present embodiment are the same as or similar to the audio signal processor 201, the amplifier 203, and the power supply 202 of the sound bar body 200 as illustrated in FIG. 18; therefore, detailed descriptions thereof will not be repeated. Output terminals of the amplifier are connected to two left connecting protrusions 311 and two right connecting protrusions 312.

The pair of terminal blocks 320 and 330, that is, the left terminal block 320 and the right terminal block 330 may be formed to have the same width and height as the center block 310. Terminals 325 and 335 to which the connection terminal 35 of the sound transducer part 30 (see FIG. 5) can be connected are provided on the top surface of the left and right terminal blocks 320 and 330. Each of the terminals 325 and 335 of the left and right terminal blocks 320 and 330 may include a + terminal and a − terminal.

Two connecting grooves 321 into which the two left connecting protrusions 311 of the center block 310 are inserted are formed on one side surface of the left terminal block 320. The two connecting grooves 321 are formed of an electrical conductor, and are electrically connected to the terminal 325. The left terminal block 320 is fixed to the center block 310 by inserting the two left connecting protrusions 311 of the center block 310 into the two connecting grooves 321 of the left terminal block 320. At this time, the terminal 325 of the left terminal block 320 is electrically connected to the amplifier of the center block 310 through the left connecting grooves 321 and the left connecting protrusions 311. Accordingly, when the sound transducer part 30 is disposed in the left terminal block 320, the connection terminal 35 of the sound transducer part 30 is electrically connected to the terminals 325 of the left terminal block 320, so that the audio signal output from the audio signal processor 21 of the sound bar body 300 is reproduced through the sound transducer part 30.

Two connecting grooves 331 into which the two right connecting protrusions 312 of the center block 310 are inserted are formed on one side surface of the right terminal block 330. The two connecting grooves 331 are formed of an electrical conductor, and are electrically connected to the terminal 335. The right terminal block 330 is fixed to the center block 310 by inserting the two right connecting protrusions 311 of the center block 310 into the two connecting grooves 331 of the right terminal block 330. At this time, the terminals 335 of the right terminal block 330 is electrically connected to the amplifier of the center block 310 through the right connecting grooves 331 and the right connecting protrusions 312. Accordingly, when the sound transducer part 30 is disposed in the right terminal block 330, the connection terminal 35 of the sound transducer part 30 is electrically connected to the terminal 335 of the right terminal block 330, so that the audio signal output from the audio signal processor of the sound bar body 300 is reproduced through the sound transducer part 30.

The length of the sound bar body 200 including the center block 310 and the pair of terminal blocks 320 and 330 is determined to correspond to the flat panel display apparatus of a minimum size. When the sound bar body 200 according to the present disclosure is applied to a large-sized flat panel display apparatus, detachable extension blocks 340 are provided between the center block 310 and the left terminal block 320 and between the center block 310 and the right terminal block 330 as illustrated in FIG. 21.

In detail, when one extension block 340 is inserted between the left end of the center block 310 and the left terminal block 320, and the other extension block 340 is inserted between the right end of the center block 310 and the right terminal block 330, the length of the sound bar body 300 may be increased.

The width W1 and the height H1 of the extension block 340 are formed to be equal to the width and height of the center block 310, and the length L1 of the extension block 340 may be determined to allow one sound transducer part 30 to be disposed on the extension block 340. Also, as illustrated in FIG. 22, two connecting grooves 342 into which the two connecting protrusions 311 and 312 provided on the side surface of the center block 310 are inserted are provided on one side surface of the extension block 340. Two connecting protrusions 341 are provided on the other side surface of the extension block 340, and are inserted into the two connecting grooves 321 and 331 provided on the side surfaces of the terminal blocks 320 and 330.

The connecting grooves 342 and the connecting protrusions 341 of the extension block 340 are formed of an electrically conductive material, and the connecting groove 342 and the connecting protrusion 341 are electrically connected to each other by a signal line 343. Accordingly, when the two connecting protrusions 311 and 312 of the center block 310 are inserted into the two connecting grooves 342 of the extension block 340 and the two connecting protrusions 341 of the extension block 340 are inserted into the two connecting grooves 321 and 331 of the terminal blocks 320 and 330, the terminals 325 and 335 of the terminal blocks 320 and 330 are electrically connected to the amplifier of the center block 310 through the extension block 340. Therefore, the length of the sound bar body 300 may be adjusted by adjusting the number of the extension blocks 340 provided between the center block 310 and the terminal blocks 320 and 330.

For example, in the case in which the sound bar body 300 according to an embodiment of the present disclosure is used in a flat panel display apparatus having a width greater than the length of the sound bar body 300 including the center block 310 and the pair of terminal blocks 320 and 330, an appropriate number of extension blocks 340 may be provided between the center block 310 and the pair of terminal blocks 320 and 330 so that the length of the sound bar body 300 is set to match the width of the flat panel display apparatus. In other words, the extension blocks 340 may be disposed between the center block 310 and the left and right terminal blocks 320 and 330 so that the left terminal block 320 protrudes to the left side of the flat panel display apparatus and the right terminal block 330 protrudes to the right side of the flat panel display apparatus.

When the sound transducer parts 30 (see FIG. 3) are provided on the terminal blocks 320 and 330 protruding to the left and right of the flat panel display apparatus, the audio signal output from the flat panel display apparatus is reproduced through the sound transducer parts 30.

As described above, when the length of the sound bar body 200 and 300 is configured to be adjusted depending on the width of the flat panel display apparatus, there is no part of the sound bar body 200 and 300 protruding outside the sound transducer part 30, so that the overall beauty of the flat panel display apparatus and the sound bar apparatus may be improved.

In the above description, the audio signal of the sound bar body is configured to be transmitted to the sound transducer of the sound transducer part by wire; however, the audio signal may be transmitted wirelessly.

Hereinafter, a sound bar apparatus having a detachable sound transducer according to an embodiment of the present disclosure configured to transmit an audio signal wirelessly will be described with reference to FIGS. 23 and 24.

Figure 23:
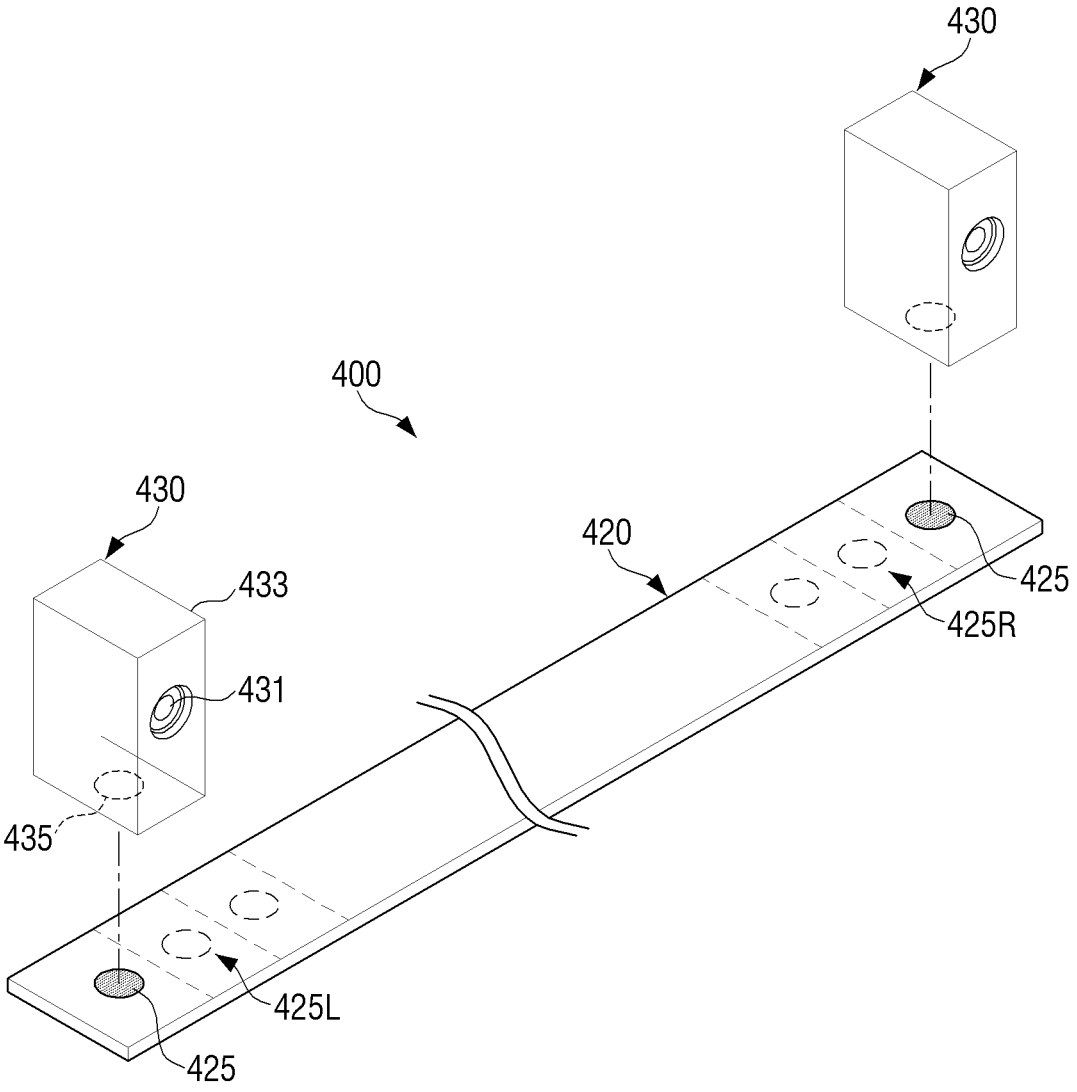
FIG. 23 is a perspective view illustrating an example sound bar apparatus having a detachable sound transducer according to another example embodiment of the present disclosure.

FIG. 23 is a perspective view illustrating an example sound bar apparatus having a detachable sound transducer according to another example embodiment of the present disclosure. FIG. 24 is a block diagram illustrating the example sound bar apparatus having a detachable sound transducer of FIG. 23.

Figure 24:
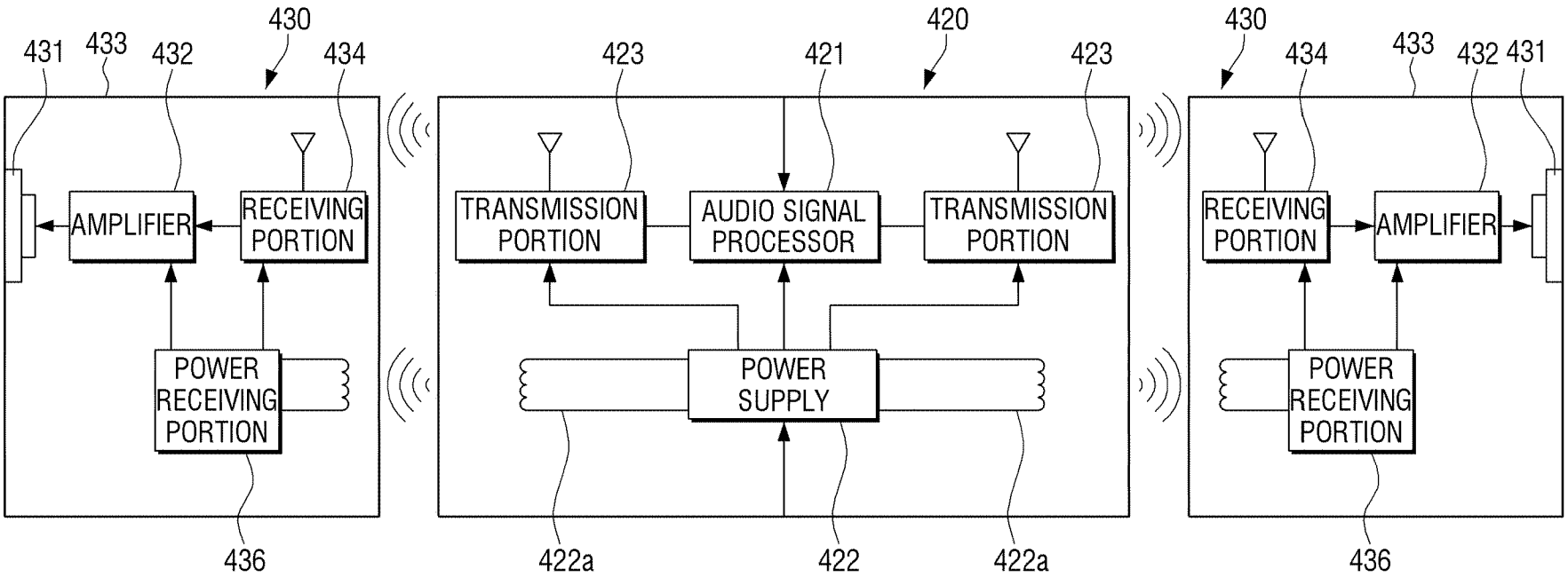
FIG. 24 is a block diagram of the sound bar apparatus having a detachable sound transducer of FIG. 23.

Referring to FIGS. 23 and 24, a sound bar apparatus 400 having a detachable sound transducer according to an example embodiment of the present disclosure may include a sound bar body 420 and sound transducer parts 430.

The sound bar body 420 is disposed in front of a flat panel display apparatus and is formed in a rod shape having a low height and a long length. For example, the sound bar body 420 may be formed in a substantially rectangular parallelepiped shape having a low height, a narrow width, and a long length, as illustrated in FIG. 23.

The length of the sound bar body 420 is determined to correspond to the width of the largest flat panel display apparatus among the flat panel display apparatuses of various sizes to which the sound bar apparatus 400 is applied. For example, in the case where the sound bar apparatus 400 of the present disclosure is formed to be applicable to flat panel display apparatuses ranging from 32 to 65 inches, the length of the sound bar body 420 is determined to correspond to the width of the 65-inch flat panel display apparatus. In detail, the sound bar body 420 may be formed to have the length long enough to accommodate two sound transducer parts 430 longer than the width of the flat panel display apparatus. For example, when the sound bar body 420 is disposed in front of the flat panel display apparatus, the length of the sound bar body 420 may be determined so that the left and right ends of the sound bar body 420 protrude to the left and right sides of the flat panel display apparatus by a predetermined length. At this time, the protruding length of the sound bar body 420 may be determined depending on the front width of the sound transducer part 430.

A plurality of fixing portions (couplers) 425 may be provided on the top surface of the sound bar body 420. The plurality of fixing portions 425 are formed to correspond to a coupling portion (coupler) 435 provided in the sound transducer part 430. Therefore, the sound transducer part 430 is fixed to the sound bar body 420 by the fixing portions 425 and the coupling portion 435.

The plurality of fixing portions 425 may be provided in a straight line in the longitudinal direction of the sound bar body 420. In addition, the plurality of fixing portions 425 are symmetrically provided on opposite side end portions of the sound bar body 420. In detail, a plurality of left fixing portions 425L are provided near the left end of the sound bar body 420, and a plurality of right fixing portions 425R are provided near the right end of the sound bar body 420. At this time, the plurality of left fixing portions 425L and the plurality of right fixing portions 425R are provided in the same number. For example, as illustrated in FIG. 23, when the left fixing portions 425L include three fixing portions 425, the right fixing portions 425R also include three fixing portions 425. The number of the plurality of left fixing portions 425L and the plurality of right fixing portions 425R may be determined depending on the number of models of the flat panel display apparatus to which the sound bar apparatus 400 of the present disclosure is applied. In the embodiment as illustrated in FIG. 23, the sound bar body 420 includes three left fixing portions 425L and three right fixing portions 425R so that the sound bar apparatus 400 may be applied to three models of the flat panel display apparatus.

The interval between the plurality of fixing portions 425 may be determined according to the difference in width of the plurality of flat panel display apparatuses to which the sound bar apparatus 400 is applied. For example, the left and right outermost fixing portions 425 may be set to fit in the 65-inch flat panel display apparatus, the left and right middle fixing portions 425 may be set to fit in the 55-inch flat panel display apparatus, and the left and right innermost fixing portions 425 may be set to fit in the 48-inch flat panel display apparatus.

The plurality of fixing portions 425 may be formed in various manners. The fixing portions 425 of the sound bar body 420 as illustrated in FIG. 23 are formed of a magnet. At this time, the coupling portion 435 of the sound transducer part 430 may be provided with a metal plate that can be attached to the magnet.

Alternatively, although not illustrated, the plurality of fixing portions 425 may be implemented in various ways as long as the sound transducer part 430 can be fixed to the sound bar body 420, such as a one-touch type, an insertion type, a hook type, or the like. At this time, the coupling portion 435 of the sound transducer part 430 is formed to correspond to the fixing portions 425 of the sound bar body 420.

Referring to FIG. 24, an audio signal processor (e.g., including processing circuitry) 421, transmission portions (e.g., including transmitting circuitry) 423, and a power supply 422 may be provided inside the sound bar body 420.

The audio signal processor 421 may include various processing circuitry and processes the audio signal output from the external input device, for example, the flat panel display apparatus, and transmits the audio signal to left and right transmission portions 423. The audio signal processor 421 is the same as or similar to the audio signal processor used in the conventional sound bar; therefore, a detailed description thereof is omitted.

The left and right transmission portions 423 include various circuitry that convert the audio signals transmitted from the audio signal processor 421 into radio signals and transmit the radio signals. The transmission portions 423 may transmit the audio signals using, for example, and without limitation, Bluetooth, WiFi, Zigbee, NFC (Near Field Communication), or the like.

The power supply 422 supplies power to the audio signal processor 421 and the transmission portions 423 and may, for example, and without limitation, be a switching mode power supply (SMPS), a DC rectifier device, a DC constant voltage device, or the like. As another example, the sound bar body 420 may be configured so that power is supplied to the audio signal processor 421 and the transmission portions 423 using a DC adapter provided in the outside of the sound bar body 420 without providing the power supply 422 inside the sound bar body 420.

The power supply 422 may be configured to transmit electricity wirelessly. For example, the power supply 422 may include a wireless power transmission device (e.g., including power transmitting circuitry) 422*a* that can transmit power to the sound transducer part 430 using a magnetic induction manner, a self-resonant manner, or the like.

The sound transducer part 430 is detachably disposed to the sound bar body 420 described above. When the sound transducer part 430 is disposed on the top surface of the sound bar body 420, the sound transducer part 430 is positioned substantially perpendicular to the sound bar body 420. In addition, the sound transducer part 30 is formed to be detachably coupled to one of the plurality of fixing portions 425 provided in the sound bar body 420. The sound transducer part 430 is disposed at the left end and the right end of the sound bar body 420 so that the audio signal can be reproduced in stereo.

The sound transducer part 430 may include an enclosure 433, a sound transducer 431, an amplifier 435, a receiving portion (e.g., including receiving circuitry) 434, and a power receiving portion (e.g., including power receiving circuitry) 436.

The enclosure 433 surrounds the sound transducer 431 and forms the outer appearance of the sound transducer part 430. As illustrated in FIG. 23, the coupling portion 435 is provided on the bottom surface of the enclosure 433, and the coupling portion 435 is formed to correspond to the fixing portions 425 of the sound bar body 420.

The receiving portion 434 may include various receiving circuitry that receives the audio signal wirelessly transmitted from the transmission portion 423 of the sound bar body 420 and transmits the received audio signal to the amplifier 432. The receiving portion 434 may be configured to receive the radio signal transmitted from the transmission portions 423 by using, for example, and without limitation, Bluetooth, WiFi, Zigbee, NFC (Near Field Communication), or the like.

The amplifier 432 amplifies the audio signal output from the receiving portion 434 and outputs the amplified audio signal to the sound transducer 431.

The sound transducer 431 receives the audio signal output from the amplifier 432 and reproduces sound. The sound transducer 431 used in the sound transducer part 430 according to the present embodiment is formed to be reproducible sounds from a low-frequency range to a high-frequency range. As another example, although not illustrated, the sound transducer part 430 may include two sound transducers: a sound transducer for a mid-frequency range and a sound transducer for a high-frequency range.

The power receiving portion 436 may include various power receiving circuitry and is configured to receive the power transmitted from the sound bar body 420 by radio and to supply the power to the amplifier 432 and the receiving portion 434. As another example, the power receiving portion 436 may be implemented by a rechargeable battery and a wireless recharging device. At this time, the wireless recharging device may receive power that is wirelessly output from the sound bar body 420 and charge the rechargeable battery.

As another example, the rechargeable battery may be configured to be charged by wire. In this case, the power supply 422 of the sound bar body 420 is configured to supply power to the sound transducer part 430 by wire. To this end, the sound bar body 420 may be provided with a power supply terminal (not illustrated), and the sound transducer part 430 may be provided with a power receiving terminal (not illustrated).

As another example, the receiving portion 436 of the sound transducer part 430 may be implemented by a battery.

As described above, since the sound bar apparatus having a detachable sound transducer according to an embodiment of the present disclosure may be applied to flat panel display apparatuses of various sizes, the manufacturing cost may be reduced.

Also, in the sound bar apparatus having a detachable sound transducer according to an embodiment of the present disclosure, since two sound transducers are provided on both sides of the flat panel display apparatus, the sound bar apparatus of the present disclosure may make the stereo sound field wider than the conventional sound bar in which two sound transducers are positioned in front of the flat panel display apparatus. Accordingly, there is an effect that sound quality is improved as compared with the conventional sound bar.

While various example embodiments of the present disclosure have been described, additional variations and modifications of the embodiments may occur to those skilled in the art once they learn of the concepts of the present disclosure. Therefore, it is intended that the appended claims shall be construed to include both the above embodiments and all such variations and modifications that fall within the spirit and scope of the present disclosure.

What is claimed is:

1. A sound bar apparatus having a detachable sound transducer comprising:

a sound bar body comprising an audio signal processor and a plurality of terminals electrically connected to the audio signal processor; and a sound transducer housing comprising a connection terminal configured to be connected to one of the plurality of terminals of the sound bar body and to receive an audio signal output from the plurality of terminals of the sound bar body, wherein the sound transducer housing is configured to be detachably connected to the sound bar body, and wherein, when the sound transducer housing is connected to the sound bar body, the connection terminal of the sound transducer housing is to receive the audio signal from the one of the plurality of terminals of the sound bar body and reproduce sound.

2. The sound bar apparatus of claim 1, wherein the plurality of terminals comprise a plurality of left terminals provided at a position at a left side of the sound bar body and a plurality of right terminals provided at a position at a right side of the sound bar body.

3. The sound bar apparatus of claim 1, wherein the sound bar body further comprises a power supply and an amplifier.

4. The sound bar apparatus of claim 3, wherein the plurality of terminals are connected in parallel to the amplifier.

5. The sound bar apparatus of claim 4, wherein the sound transducer housing includes:

a sound transducer for a mid-frequency range;

a sound transducer for a high-frequency range;

a crossover network comprising circuitry for a mid-frequency range provided between the connection terminal and the sound transducer for the mid-frequency range; and a crossover network comprising circuitry for a high-frequency range provided between the connection terminal and the sound transducer for the high-frequency range.

6. The sound bar apparatus of claim 3, wherein the amplifier comprises a mid-range amplifier and a tweeter amplifier, and wherein the plurality of terminals comprises a plurality of mid-range terminals connected in parallel to the mid-range amplifier, and a plurality of tweeter terminals connected in parallel to the tweeter amplifier.

7. The sound bar apparatus of claim 6, wherein the sound transducer housing includes a sound transducer for a mid-frequency range and a sound transducer for a high-frequency range, and wherein the connection terminal comprises a mid-range connection terminal connected to the sound transducer for the mid-frequency range and a tweeter connection terminal connected to the sound transducer for the high-frequency range.

8. The sound bar apparatus of claim 3, wherein the sound bar body further comprises a woofer amplifier and a woofer terminal configured to be connected to the woofer amplifier.

9. The sound bar apparatus of claim 1, wherein each of the plurality of terminals of the sound bar body includes a + terminal and a − terminal, and wherein the connection terminal of the sound transducer housing includes a + connection terminal and a − connection terminal corresponding to the + terminal and the − terminal.

10. The sound bar apparatus of claim 9, wherein one of the plurality of terminals of the sound bar body and the connection terminal of the sound transducer housing comprises a conductive magnet and another one of the plurality of terminals of the sound body and the connection terminal of the sound transducer housing comprises a conductive metal material.

11. The sound bar apparatus of claim 1, wherein the sound bar body has a height less than a threshold height, a width less than a threshold width, and a length greater than a threshold length, and wherein the plurality of terminals are provided on a top surface of the sound bar body.

12. The sound bar apparatus of claim 11, wherein the connection terminal of the sound transducer housing is provided on a bottom surface of the housing.

13. The sound bar apparatus of claim 1, wherein the sound bar body is configured to extend and retract in a telescopic manner.

14. The sound bar apparatus of claim 1, wherein the sound bar body comprises:

a center block in which the audio signal processor is provided; and a pair of terminal blocks detachably disposed at both ends of the center block, each of the pair of terminals including one terminal.

15. The sound bar apparatus of claim 14, further comprising an extension block configured to be detachably disposed between the center block and the pair of terminal blocks.

16. The sound bar apparatus of claim 1, further comprising:

a coupler configured to fix the sound transducer part to the sound bar body.

17. A sound bar apparatus having a detachable sound transducer comprising:

a sound bar body comprising an audio signal processor and a plurality of couplers electrically connected to the audio signal processor; and a sound transducer housing comprising a coupler connected to one of the plurality of couplers of the sound bar body, wherein the plurality of couplers of the sound bar body are provided in a longitudinal direction of the sound bar body and to receive an audio signal output from the plurality of couplers of the sound bar body, wherein the sound transducer housing is configured to be detachably coupled to the sound bar body, and wherein when the sound transducer housing is connected to the sound bar body, the coupler of the sound transducer is configured to receive the audio signal from the one of the plurality of couplers of the sound bar body and reproduce sound.

18. The sound bar apparatus of claim 17, wherein the plurality of couplers provided on the sound bar body and the coupler provided on the sound transducer part comprise a terminal for transmitting audio signals.

19. The sound bar apparatus of claim 17, wherein the sound bar body is configured to transmit power and audio signals wirelessly to circuitry disposed in the sound transducer housing.

20. The sound bar apparatus of claim 19, wherein the sound transducer housing comprises circuitry configured to receive the power and audio signals wirelessly transmitted from the sound bar body.

* * * * *